United States Patent [19]

Katoh

[11] 4,154,610

[45] May 15, 1979

[54] PHOTOGRAPHIC METHOD AND FILM UNIT

[75] Inventor: Kazunobu Katoh, Odawara, Japan

[73] Assignee: Fuji Photo Film Co., Ltd., Minami-ashigara, Japan

[21] Appl. No.: 855,130

[22] Filed: Nov. 28, 1977

Related U.S. Application Data

[62] Division of Ser. No. 626,892, Oct. 29, 1975, abandoned.

[30] Foreign Application Priority Data

Oct. 31, 1974 [JP] Japan ..... 49-126184
May 23, 1975 [JP] Japan ..... 50-62238

[51] Int. Cl.[2] ..... G03C 5/54; G03C 7/00; G03C 1/48; G03D 9/02

[52] U.S. Cl. ..... 96/29 R; 96/3; 96/29 D; 96/76 R; 96/76 C; 96/77; 96/200; 96/201; 354/179; 354/304

[58] Field of Search ..... 96/76 C, 77, 3, 29 R, 96/29 D, 200, 201; 354/304, 179

[56] References Cited

U.S. PATENT DOCUMENTS

| | | | |
|---|---|---|---|
| 3,415,645 | 10/1968 | Land | 96/3 |
| 3,415,646 | 10/1968 | Land | 96/3 |
| 3,594,165 | 7/1971 | Rogers | 96/3 |
| 3,635,707 | 1/1972 | Cole | 96/3 |
| 3,647,435 | 3/1972 | Land | 96/3 |
| 3,778,271 | 12/1973 | Land | 96/77 |
| 3,865,593 | 2/1975 | Yoshida | 96/77 |
| 3,880,658 | 4/1975 | Lestina et al. | 96/3 |
| 3,960,558 | 6/1976 | Cardone | 96/3 |

*Primary Examiner*—Richard L. Schilling
*Attorney, Agent, or Firm*—Sughrue, Rothwell, Mion, Zinn and Macpeak

[57] ABSTRACT

Photographic method and film unit wherein a positive image is produced in a film unit by diffusion-transfer process and is viewable from the opposite side of the film unit to the side onto which image-wise light is initially directed, whereby image-reversal means in the optical system of a camera are unnecessary. After exposure, a film unit is moved into a reception means providing lightproof protection to photosensitive portions thereof and also permitting viewing of formation of a positive image therein, the film unit being removable from the reception means after effective completion of photographic processes therein.

42 Claims, 31 Drawing Figures

PHOTOGRAPHIC METHOD AND FILM UNIT

This is a division of application Ser. No. 626,892, filed Oct. 29, 1975 now abandoned.

The present invention relates to a photographic method for production of photographs by diffsusion-transfer process and to a film unit therefor. More particularly the invention relates to a photographic method and film unit according to which a latent image layer of a film unit is exposed to image-wise light directed onto one side of the film unit, lightproof protection is subsequently provided on both sides of the latent image layer until development and positive image production processes in the film unit are effectively completed, and the positive image is viewable from the opposite side of the film unit.

In production of photographs by diffusion transfer process there is provided film material which is generally provided in the form of individual units, each comprising at least a first, photosensitive layer, generally a silver halide emulsion layer, exposed silver halide grains of which may define the latent image of an object subsequent to a development process, and a second, hydrophilic colloid layer onto which image elements corresponding to elements constituting the latent image formed in the first layer may be diffused and transferred, and subsequently fixed, whereby there is produced in the second layer a positive image of the object to be photographed. A main feature of the diffusion-transfer process is that since latent and positive images are produced in different layers of a film unit, there is no necessity for subsequent development, fixing, bleaching or other processes. In other words, a positive, viewable image of an object may be obtained almost immediately subsequent to exposure of a film unit, and it is not necessary for a photographer to proceed to a specially equipped establishment for development of film and production of positive copies of photographs.

The layer for formation of a diffused image consists of a complex silver salts material if the film unit is employed for production of a black and white photograph, and of a colour donor material if it is required to produce a colour photograph. Further details of suitable materials will be given below.

There has been proposed a type of film unit image-producing portions of which are brought into contact with a processing solution or medium subsequent to exposure of the film unit. Photosensitive elements of the film unit are then protected from light, the film unit is withdrawn from the camera in which it was exposed and image-production processes are completed in a light location, i.e., in a location in which there are not necessarily the same lightproof conditions such as obtain in the interior of the camera.

In one type of film unit, such as disclosed in U.S. Pat. No. 3,415,644, No. 3,573,043, and No. 3,615,421, for example, a completed positive image in the film unit is viewed from the same side of the film unit as that onto which image-wise light for exposure of the film unit was initially directed. In this type of film unit lightproof protected may be effected, when required, in a comparatively simple manner, but there is the disadvantage that in order to avoid reversal of left and right in a completed print the optical system of the camera for intial direction of image-wise light onto the film unit to effect exposure thereof must include image-reversal means, whereby camera construction is rendered more complex, and also more costly since the image-reversal means must employ precision elements, and there is increased possibility of misalignment of component elements in the optical system of the camera, and consequent incorrect focus.

Thus it is advantageous to make available a film unit wherein a completed image is viewable from the opposite side of the film unit to that which is initially exposed to image-wise light. However, in such a type of film unit it is necessary to provide lightproof protection to both sides of the latent image layer during processing of the film unit. Known methods for provision of lightproof protection include provision of a layer which is permeable to processing solution, contains a material such as carbon black for absorption of light and is applied over the entire rear surface of the latent image layer, i.e., the surface thereof which is the opposite side to the surface onto which image-wise light is directed. Requirements of lightproof protection means in this type of film unit are on the one hand that there be caused no scattering or unrequired absorption of light during exposure of the latent image layer, and on the other hand that complete exclusion of strong external light be afforded during processing of the film unit. Examples of known means for effecting lightproof protection to film units are disclosed in U.S. Pat. No. 3,415,645, and No. 3,415,646, according to which there is provided in association with each film unit an opaque sheet which is disposable over the front of the film unit, is moveable to uncover the film unit during exposure of the film unit, and then moveable back to a position to cover the film unit. Such means, however, while being able to provide very effective lightproof protection to the film unit, has the disadvantage that an associated camera must have a complex construction and must be larger, in order to effect and to accommodate requisite movement of such opaque sheets, in addition to which the number of film units which can be held in a pack, or cassette, of a given size in which film units are normally contained is evidently reduced, and film pack construction itself becomes more complex. Also loading of a film pack into a camera is generally made more difficult since it is necessary to effect initial engagement of camera elements with the opaque sheet associated with the foremost film unit in the pack, and because of such engagement it may be difficult to unload a film pack before all the film units thereof have been exposed and processed.

In another method, disclosed in U.S. Pat. No. 3,635,707, lightproof protection is provided by spreading processing solution containing a light-absorbent substance over the forward side of an exposed latent image layer. This method is suited to employment in a film unit in which the positive image layer and latent image layer of a film unit are successively applied on a single support medium, but is unsuited to employment in association with the present invention, according to which the latent image layer and positive image layer are each supported on a separate support medium.

According to another known means disclosed in U.S. Pat. No. 2,607,685 there is employed a three-sheet construction comprising a latent image sheet, a positive, or transfer, image layer, and an additional transparent sheet, and there is also provided a solution of an opaque medium which is spread through the film unit simultaneously with, but separately from processing solution for effecting image development and diffusion and transfer. However, in such a film unit there are technical problems associated with simultaneous spreading of two different layers through the film unit, in addition to which finished prints tend to be somewhat bulkier than is suited for good appearance, and a larger film pack must be employed in order to contain a standard number of film units.

There are also known photographic means such as disclosed in Japanese Patent Publications No. 49-33655 and No. 49-33656 and U.S. Pat. No. 2,467,320 according to which after exposure a film unit is moved out of a pack, passed through processing means, and temporarily accommodate in a reception compartment provided as an adjunct to the camera, the film unit being removeable from this compartment upon completion of image production processed. In such means, since no lightproof protection means is provided within a film unit itself, the reception compartment must constitute a completely lightproof enclosure. Thus, in such a means, for example employing a Polaroid SX-70 camera, trademark owned by the Polaroid Corporation, since there is no opening in the reception compartment a photographer may not have the pleasure of observing the stages of production of a positive image in a film unit, and since it is not possible to know immediately whether or not a photograph has been taken in a desired manner, the photographer can not decide rapidly whether or not to re-photograph a particular object.

It is accordingly an object of the present invention to provide a photographic method and film unit wherein film material is exposed to image-wise light directed onto one side thereof by an optical system of an ordinary camera not requiring inclusion of image-reversal means, thereby to produce a latent image of an object in a photosensitive layer of the film material, lightproof protection is then provided on both sides of the layer carrying the latent image, and there is produced a positive image of the object in another layer of the film material which is viewable from the opposite side of the film material to the side thereof onto which image-wise light was initially directed.

It is another object of the invention to provide a photographic method and film unit wherein it is not necessary to separate component portions of a film unit subsequent to production of a photographic image in the film unit.

It is a further object of the invention to provide a photographic method wherein photosensitive portions of a film unit are protected from exposure to external light during processing of the film unit.

It is a still further object of the invention to provide a photographic method and film unit wherein there is provided means for accommodation of a processed film unit.

It is a still another object of the invention to provide a photographic method and film unit wherein it is possible to observe the pocess of positive image transfer and production immediately after exposure of the film unit.

It is a further object of the invention to provide a photographic method and film unit wherein an exposed and processed film unit may be withdrawn from or left in a camera or associated accommodation means as required by a photographer, and wherein a positive image formed in a film unit may be viewed, regardless of whether the film unit is withdrawn from or left in a camera or associated means.

In accomplishing these and other objects there is provided, according to the present invention, a photographic method and film unit wherein a film unit comprises a first transparent support and a second transparent support, which are initially bonded along edge portions, and between which there is provided at least a layer of photosensitive material able to form a latent image of an object upon exposure thereof to image-wise light reflected from the object, and a layer of material able to form a positive, viewable image of the object upon diffusion and transfer thereto, under the influence of processing solution, of image elements corresponding to elements constituting the image formed in the latent image layer, this diffusion and transfer of image elements being effected by the action of processing solution which is spread through the film unit by pressure means which may be provided in a camera and through which the film unit is passed subsequent to exposure thereof. In front to rear order with respect to a camera in which the film unit is positioned for exposure the component portions of the film unit are disposed in the order: first transparent support, latent image layer, positive image layer, and second transparent support. The processing solution is suitably provided in a breakable container mounted along the edge portion of the film unit which first passes through the processing means and is so constructed and positioned as to permit extrusion of processing solution therefrom to between the first and second transparent supports. Spread of processing solution through the film unit is facilitated by the fact that only edge portions of the first and second transparent supports are bonded.

The first transparent support may simply serve to retain processing solution spread through the film unit, in which case the latent image layer and positive image layer are both supported by the second transparent support and, upon extrusion thereof from the processing solution container, processing solution is initially spread on the forward side of the exposed latent image layer or the latent image layer may be supported by the first transparent support and the positive image layer by the second transparent support, in which case processing solution is initially spread between the latent image layer and the positive image layer.

A requisite in production of a photograph by diffusion-transfer process such as described above is that after exposure of the latent image layer of a film unit to image-wise light the latent image layer be protected from further exposure to external light for a time sufficient for diffusion and transfer to image elements to the positive image layer to be completed, since otherwise such external light could cause further, unrequired reaction in the latent image layer, resulting in an unclear photograph in the positive image layer. According to the invention, such lightproof protection of the latent image layer is provided by an opaque layer in the film unit and by a reception or container means into which the film unit is inserted subsequent to passage thereof through the pressure means for effecting spread of processing solution therethrough.

If the first transparent support serves to support the latent image layer as well as retain processing solution in the film unit, the opaque layer in the film unit may be a layer of opaque material which is also permeable to processing solution and is provided between the latent image layer and positive image layer during initial construction of the film unit, an example of such a layer being disclosed in Japanese Patent Publication No. 49-126184, or the layer may be constituted subsequent to exposure of the film unit by suitable components included in the processing solution spread between the first and second transparent support sheets. If the first transparent sheet simply serves to retain processing solution in the film unit the opaque layer is made of a material permeable to processing solution and is initially provided between the latent image layer and positive image layer. In the case of an initially provided opaque layer, the layer may, of course, be made of a material which is normally opaque or of a material which becomes opaque upon combination with suitable substances provided in the processing solution.

The reception or container means into which the film unit is inserted after exposure, may be constituted by a compartment which is provided in connection to a side portion of the camera in which the film unit is exposed, and, according to requirements, may be suited to accommodation of only one, or of a plurality of film units or by envelope or bag means provided in association with an individual film units. In all types of reception or container means according to the invention there is provided a viewing opening through which formation of an image in the positive image layer of a film unit may be observed, other portions of the means being opaque, whereby the latent image layer is protected on one side by these other portions and on the other side by the opaque layer provided or formed in the film unit. Thus there is no risk of undesired exposure of the latent image layer, but a photographer may have the pleasure of observing the process of positive image production, and may also know very rapidly whether or not a photograph has been taken in a required manner. After a time sufficient for development and image production processes to have been effectively completed, the film unit may be removed from the reception or container means without risk of external light altering the quality of the completed print.

A better understanding of the present invention may be had fron the following full description of several preferred embodiments thereof when read in reference to the attached drawings, in which like numbers refer to like parts, and FIG. 1 is a schematic cross-sectional view showing film unit construction according to one embodiment of the invention;

FIG. 2 (I) and 2 (II) are greatly enlarged cross-sectional views showing the film unit of FIG. 1 prior to and subsequent to passage thereof through a processing means;

FIG. 3 (I) and 3 (II) are respectively front and rear perspective views of the film unit of FIG. 1;

Figure 12:
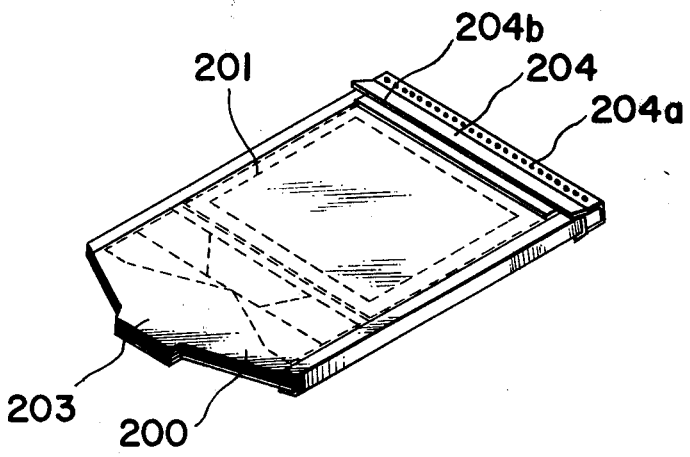
FIG. 12 is a front view of a lightproof film unit reception envelope according to another embodiment of the invention.
Figure 19:
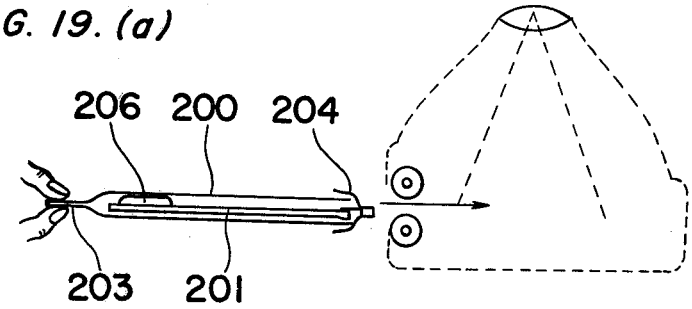
Figure 19:
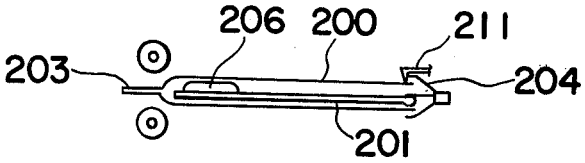
Figure 19:
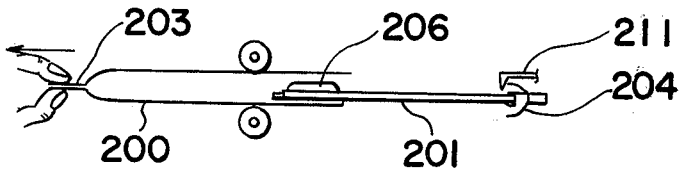
Figure 19:
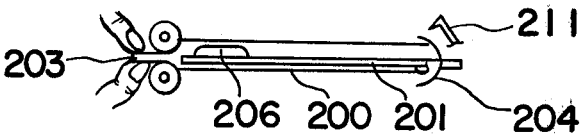
Figure 19:
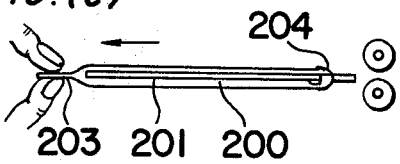
Figure 20:
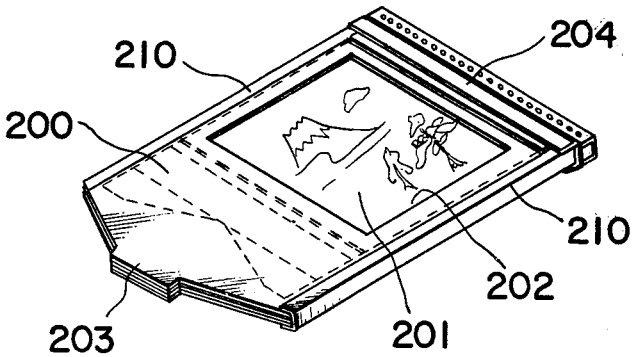
Figure 21:
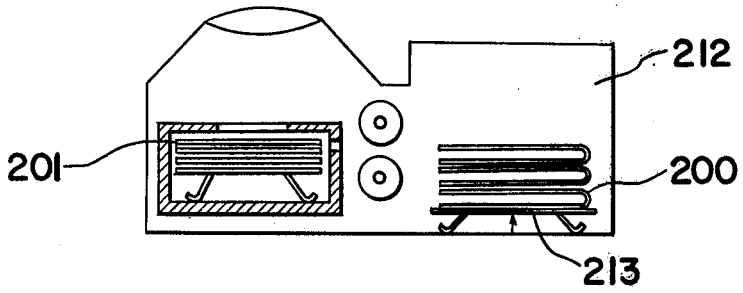
Figure 22:
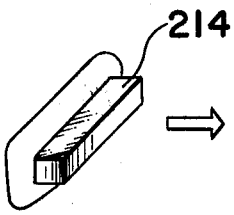
Figure 22:
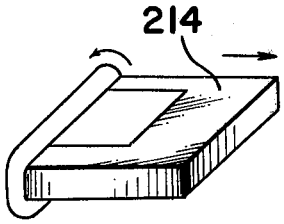
Figure 23:
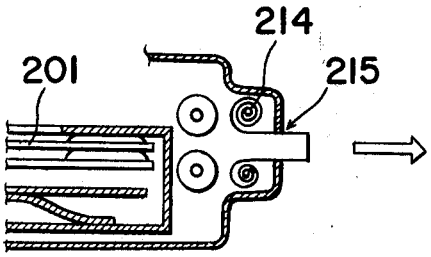
Figure 23:
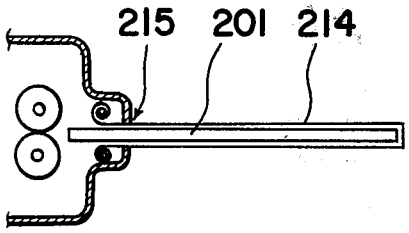

FIG. 19 (a) through (d) are schematic views showing mode of insertion into a camera, exposure and removal from a camera of a film unit associated with the envelope of FIG. 12;

FIG. 20 is a perspective view showing a processed film unit contained in the envelope of FIG. 12;

FIG. 21 is a schematic cross-sectional view in illustration of another mode of photograph production employing the lightproof means of FIG. 12;

FIG. 22 (I) and 22 (II) are perspective views respectively showing the rolled and unrolled condition of lightproof container means according to another embodiment of the invention; and FIG. 23 (I) and 23 (II) are schematic cross-sectional views illustrating employment of the means of FIG. 22.

Figure 1:
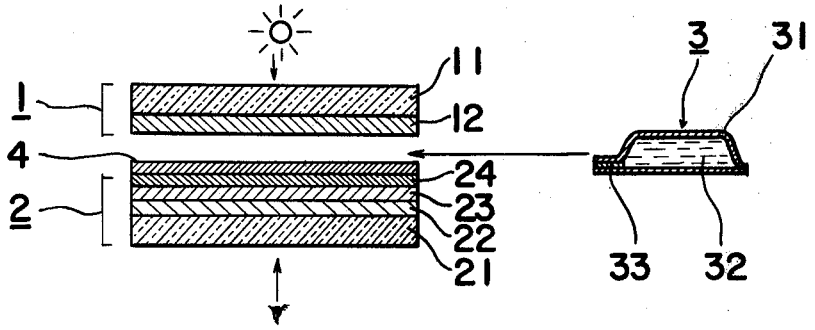

Referring of FIG. 1, there is shown a film unit comprising a first assembly sheet 1, second assembly sheet 2, processing solution container assembly 3, and opaque sheet 4. The first assembly sheet 1 is on the forward side of the film unit, i.e., the side of the film unit onto which image-wise light is directed to effect initial exposure of the film unit, and comprises a forwardmost layer of transparent, dimensionally stable material constituting a first transparent support 11 and a layer of photosensitive material constituting a latent image layer 12 in which a latent image may be formed upon direction of image-wise light thereon. The second assembly sheet 2 comprises, in rear to front order, a layer of transparent, dimensionally stable material constituting a second transparent support 21, a neutralization layer 22 for neutralization of processing solution spread through the film unit, a neutralization retarder layer 23 which prevents the neutralization layer 22 from taking effect before the processing solution has been effective in causing diffusion and transfer of a photographic image, and a positive image layer 24 in which a positive, viewable image corresponding to a latent image formed in the latent image layer 12 may be formed under the influence of processing solution. The opaque sheet 4 is provided on the forward side of the positive image layer 24 and is effectively supported by the second transparent support 21, as are also the layers 22 through 24. The sheet 4 suitably has a multi-layer structure, is permeable to processing solution, and may comprise a material which itself imparts opacity to the sheet 4, or a material which renders the sheet 4 opaque when combined with suitable components included in the processing solution.

The first assembly sheet 1 and second assembly sheet 2, including the opaque sheet 4, are suitably so attached or positioned relative to one another that there is defined therebetween a space in which processing solution may be spread in a layer.

The processing solution container assembly 3 is provided along a leading edge portion of the film unit, i.e., the edge portion of the film unit which leads when the film unit is moved through processing means, is in line with the space defined between the first assembly sheet 1 and second assembly sheet 2, and comprises laminate sheet or other suitable sheet material which defines a container 31 holding processing solution 32, and has free edge portions which are disposed inwardly with respect to the film unit and are bonded by a weakly adhesive layer 33 which may be broken open by pressure applied thereon by processing solution 32 when the film unit is passed through suitable known pressure means for film unit processing, whereby the processing solution 32 may be moved out of the container 31 and spread in a layer 34 between the first assembly sheet 1 and second assembly sheet 2.

Figure 2:
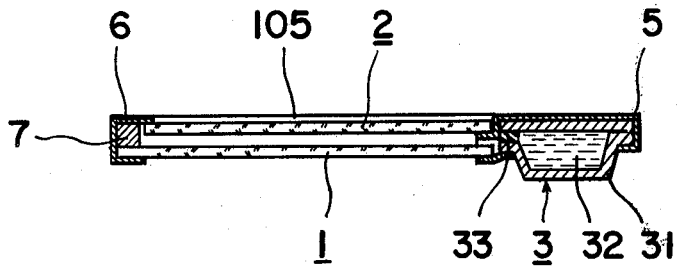
Figure 2:
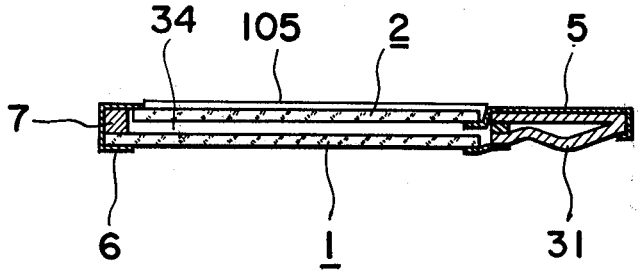

Referring now to FIG. 2 (I) and FIG. 2 (II), which respectively show a film unit prior to passage thereof through processing means, when processing solution is retained in the container 31, and subsequent to passage of the film unit through processing means, when processing solution has been extruded from the container 31 and spread in a layer 34 between the first assembly sheet 1 and second assembly sheet 2, along the leading edge of the film unit there is provided a bracket-like support element 5 which is made of a comparatively rigid material and serves to strengthen the leading edge portion of the film unit and to hold the processing solution container assembly 3 in a position wherein the weakly adhesive layer 33 actually in or in line with the space defined between the first assembly sheet 1 and second assembly sheet 2. The trailing edge of the film unit, i.e., the edge thereof opposite to the leading edge, is enclosed by a bracket support element 6, which is also made of a comparatively rigid material, and which closes and holds in place a trap 7 which serves to trap, or absorb, excess processing solution 32 which is not employed in production of a photograph in the film unit. The excess solution trap 7 is suitably a fibrous or porous material, and may be constituted, for example, by paper material in which there are formed a great number of small holes. Bracket-like strengthening elements may of course also be provided along side edge portions of the film unit, although simple bonding of component sheets and layers of the film unit can be sufficient to impart requisite strength to film unit side edge portions.

Figure 3:
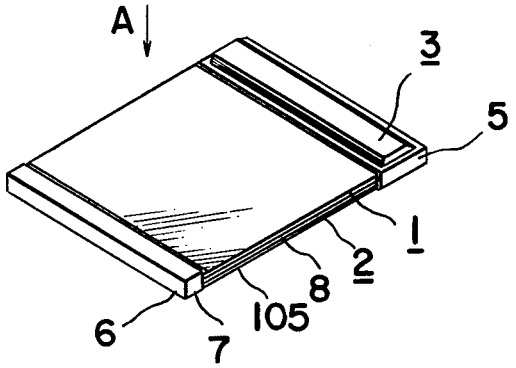
Figure 3:
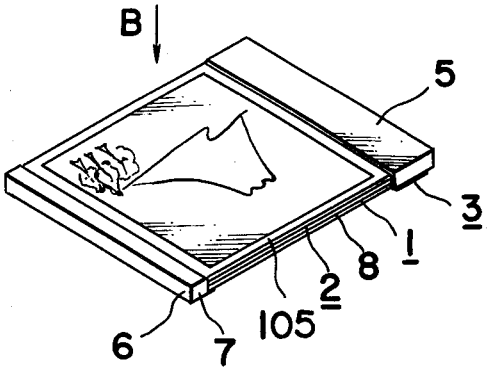
Figure 11:
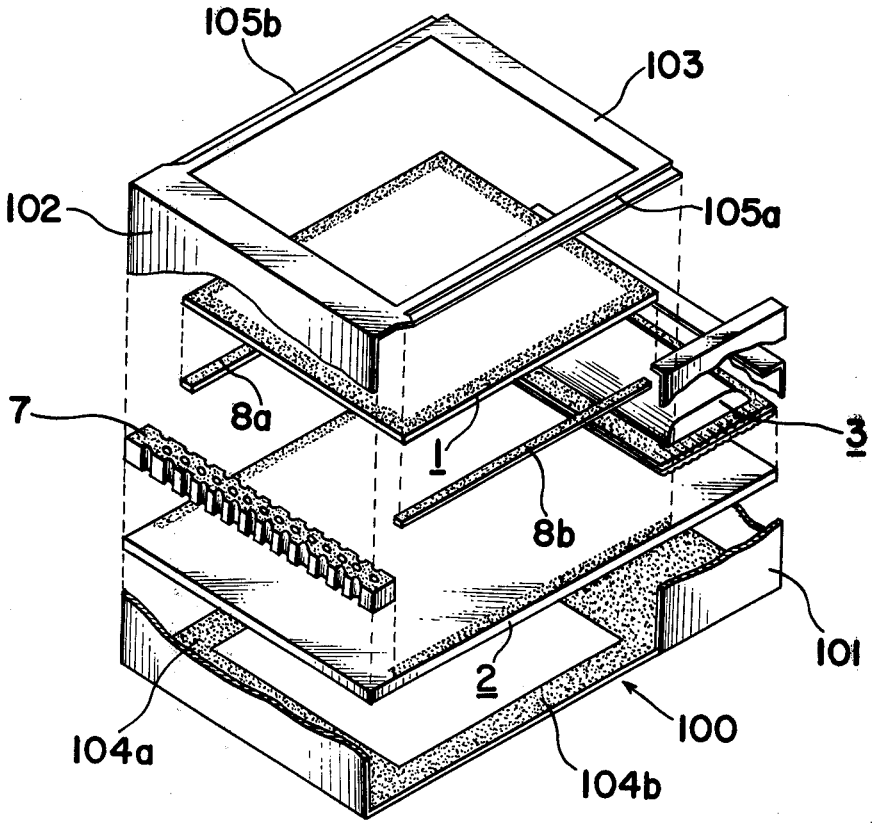
FIG. 11 is a perspective exploded view showing disposition of film unit support means according to another embodiment of the invention.

Referring to FIG. 3 (I) and FIG. 3 (II), side edge portions of the film unit are further strengthened by spacers 8, which serve to maintain the first and second assembly sheets 1 and 2 at a set distance from one another, thereby permitting flow of processing solution between the first and second assembly sheets 1 and 2 and also determining the thickness of the resultant layer 34 of processing solution 32, and also to prevent leakage of processing solution 32 from side edge portions of the film unit. Spacers 8*a*, 8*b*, at opposite sides of the film unit may be separate elements, or may be opposite sides of a sheet material from which a central portion generally equal in area to the image formation portions of the film unit is removed, as shown in FIG. 11. A spacer 8 is suitably constituted by a strip of paper or plastic material having coated on each opposite side thereof a layer of adhesive or of a thermoplastic bonding agent by which the spacer 8 is bonded to the first assembly sheet 1 or second assembly sheet 2.

The spacer 8 may be permanently or detachably bonded, according to the purpose of the film unit. For example, if the film unit is of the type in which, subsequent to exposure and processing thereof, it is required to detach the first assembly sheet 1 from the second assembly sheet 2, in order to employ the latent image layer 12 as a negative for obtaining enlargements of other copies of the photograph carried in the positive image layer 24 of the second assembly sheet 2, at least one side of the spacer 8 is bonded to the first assembly sheet 1 or second assembly sheet 2 by a comparatively weak bonding agent which permits such detachment of the 1st assembly sheet 1.

Various known bonding means for bonding the spacer, or spacers, 8 may be employed, for example, means affording direct bonding such as a bonding agent containing a volatile medium, or a bonding agent which is constituted by a thermoplastic polymer and is suited to heat seal procedures, or means for indirect bonding such as pressure sensitive tape. Another suitable mode of bonding is that disclosed in U.S. Pat. No. 2,563,387 and No. 2,659,673 according to which bonding may be effected by provision of an agent having a double-layer structure, for example, a zein layer and an ethylcellulose layer, or a polyvinyl alcohol layer and an ethylcellulose layer. To provide contrast for viewing of a positive photographic image, the second transparent support 21 may have applied thereon a border 105 of suitable material, for example Graviacote.

The abovedescribed film unit is positioned in a camera wherein the latent image layer 12 thereof is exposed to image-wise light which is directed onto the forward side thereof, as indicated by the arrow A in FIG. 3(I), and passes through the first transparent support 11. After this, the film unit is passed through processing means which applies pressure to cause the processing solution 32 to be spread in a layer 34 between the first assembly sheet and second assembly sheet 2, as illustrated in FIG. 2(II), the solution 32 causing development of the latent image in layer 12, and subsequent diffusion through the opaque sheet 4 and onto the positive image layer 24 of image elements corresponding to this latent image, thereby producing in the layer 24 a fixed positive image which appears through the second transparent support 21 and is viewable from the rear of the film unit, as indicated by the arrow B of FIG. 3(II).

During latent image development and production of a positive image by diffusion-transfer process in the abovedescribed film unit, it is desirable that the exposed latent image layer 12 be protected from external light, which, if allowed to impinge on the latent image layer 12 would be liable to result in production of image elements other than those constituting the image of the object from which light for exposure of the latent image layer 12 was initially reflected, or in production of a blurred photograph. Such lightproof protection of the latent image layer 12 may be afforded by means and in a manner illustrated in FIGS. 4 through 6, to which reference is now had.

Figure 4:
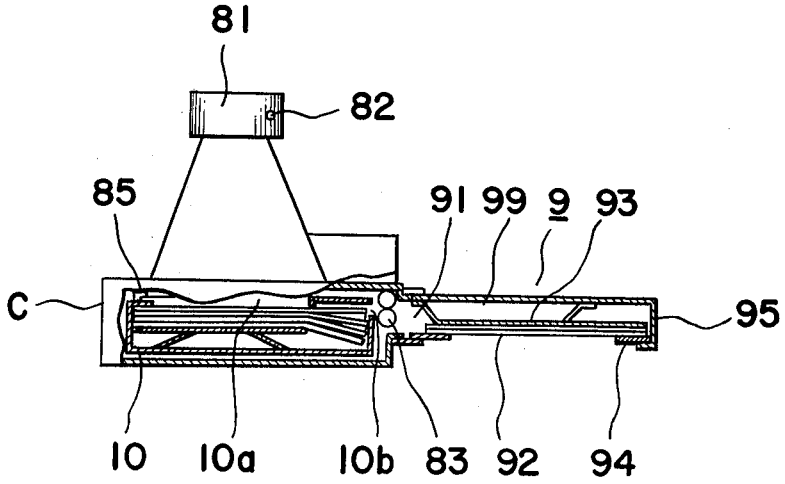
FIG. 4 is a cross-sectional view showing main portions of a photographic means according to one embodiment of the invention.

In FIG. 4, a plurality of film units are provided in a container or pack 10, which is loadable is a camera C having an adjustable lens system 81 a shutter button 82 for actuation of a suitable shutter system not indicated in order to permit image-wise light to be directed by the lens system 81 into the interior of the camera C. Imagewise light thus directed into the camera C passes through an exposure opening 10*a* formed in the front wall of the pack 10 and exposes the latent image layer 12 of the foremost film unit in the pack 10, film units being urged towards the front of the pack 10 and successive film units being brought to a foremost position in alignment with the exposure opening due to the action of suitable spring means provided actually within the pack 10 or forming part of the camera C. During this exposure of the foremost film unit, light is prevented from reaching other film units or the second assembly sheet 2 of the foremost film unit by the opaque layer 4 of the foremost film unit. Upon termination of action of the camera shutter means, a forwarding means, such as a pawl element 85, for example, is actuated and moves the exposed foremost film unit out of the pack 10, via a slit 10*b* formed in a side wall thereof, and into engagement with pressure means such as pressure rolls 83, for example, which are provided in the camera C and which also are actuated in conjunction with termination of camera shutter action. The rolls 83 draw the exposed film unit out of the pack 10 and into a reception compartment 9 which is fixedly or detachably mounted on a side of the main portion of the camera C, in line with the film pack, the next film unit being moved to a foremost position in the pack 10 after complete removal of the exposed film unit from the pack 10, and action of the rolls 83 being terminated after a time sufficient for the exposed film unit to have been moved completely into the reception compartment 9.

Figure 5:
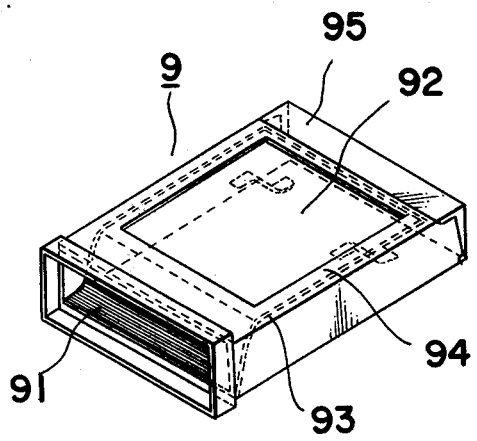
FIG. 5 is a perspective view of a film unit reception compartment associated with the photographic means of FIG. 4.

In FIGS. 4 and 5, the film unit reception compartment 9 comprises opaque walls defining an interior 99 and an entrance 91 which communicates with the camera interior and via which successive film units may be inserted into the interior 99. The rear wall of the reception compartment 9 is replaced by a frame 94 defining a window 92 which covers an area smaller than that covered by a film unit and via which the image formed on the positive image layer 24 of the exposed film unit may be viewed, the 2nd assembly sheet 2 of the exposed film unit being rearmost when the exposed film unit is moved into the reception compartment 9, and the film unit being urged into contact with the frame 94 by pressure plate means 93 mounted on the front wall of the reception compartment 9 and acting rearwardly. When the exposed film is thus pressed against the frame 94, in the manner illustrated in FIG. 6, complete lightproof protection is afforded to the compartment interior since the reception compartment is made of opaque material and external light is prevented from passing through the exposed film unit by the opaque sheet 4 of the film unit. The exposed film unit may subsequently be removed after opening of a cover 95, which is also made of opaque material and normally closes the outer side of the reception compartment 9, i.e., the side thereof furthest removed from the main portion of the camera C. The reception compartment 9 may be adapted to accommodation of a plurality of exposed film units, it thus being unnecessary to remove each successive exposed film unit before exposure of the next film unit. In this case the last exposed film unit is guided into the rearmost position in the reception compartment 9. An exposed film unit may be extracted as a complete unit from the compartment 9, i.e., with the first and second assembly sheets 1 and 2 of the film unit still in attachment to one another, or, if the film unit is of the type which is intended to provide a film negative for production of additional copies of a photograph, in the vicinity of the cover 95 there may be provided means, not shown, which cause separation of the first assembly sheet 1 from the second assembly sheet 2 as the film unit is moved from the compartment 9.

Since the window 92 is merely intended to permit viewing of the positive image in layer 24 of a film unit, it may be simply an opening. However, to prevent entry of dust etc., the window 92 is preferably constituted by transparent plastic or glass supported by the frame 94.

Figure 6:
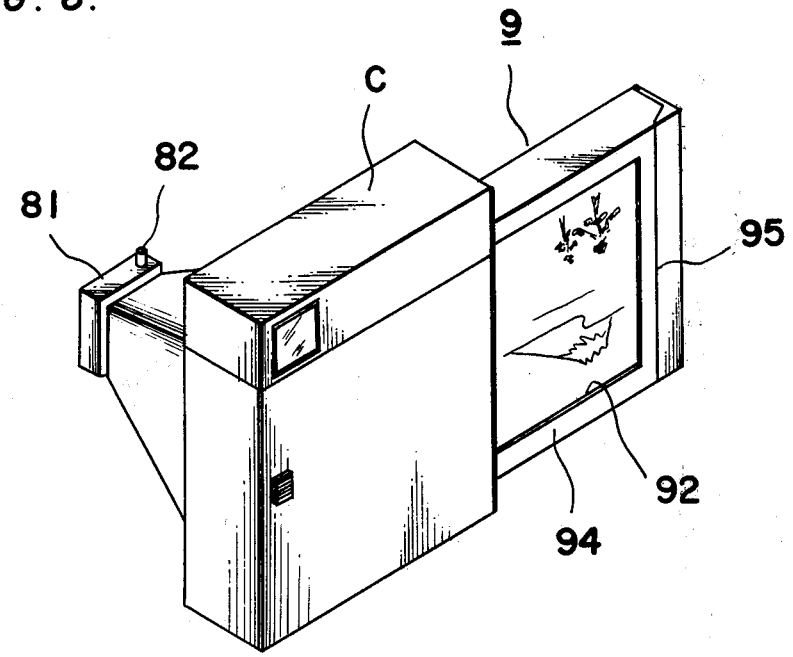
FIG. 6 is a perspective rear view of the photographic means of FIG. 4.
Figure 7:
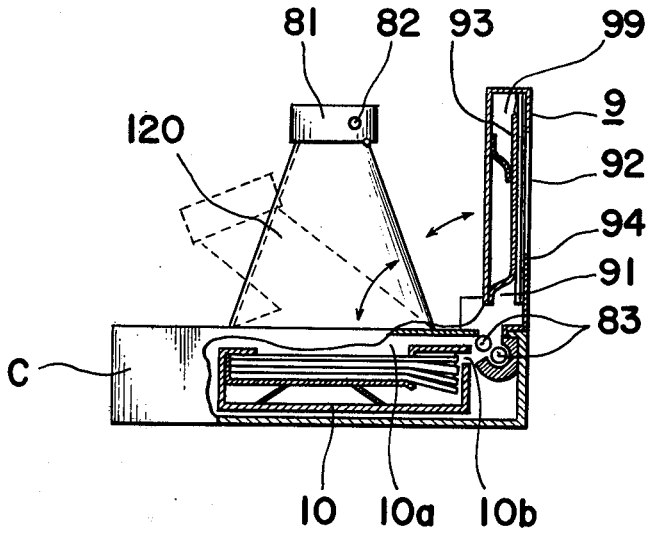
FIG. 7 is cross-sectional view of a photographic means according to another embodiment of the invention.

The reception compartment 9 may extend sideways from the main portion of the camera C, generally in line with the rear wall of the camera C, as illustrated in FIG. 6, in which case transfer of an exposed film unit from the pack 10 to the interior 99 of the reception compartment 9 is may be effected in straight line movement, or the reception compartment 9 may be disposed generally at right-angles to the rear wall of the camera C and extend forwardly from a side portion of the camera C, as illustrated in FIG. 7, in which case an exposed film unit is turned through 90° during transfer thereof from the pack 10 to the compartment 9.

Figure 8:
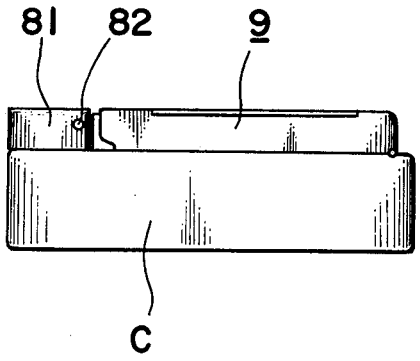
FIG. 8 is a perspective view showing the photographic means of FIG. 7 in a folded condition.

There may of course be provided a construction such as disclosed Japanese Patent Application Ser. No. 49-102625 assigned to the present applicant, according to which, as illustrated simply in FIGS. 7 and 8, the lens mount 120 and film unit reception compartment 9 may both be set in forwardly extending positions with respect to the main portion of the camera C, during use of the camera C, but may also be folded in generally flat alignment with respect to the camera C main portion by means of known flexible material or conventional hinged mamber(not shown), thus offering the advantage of a compact, easily portable assembly during nonuse of the camera C.

To resume, in reference to FIGS. 4 and 6, after being exposed, a foremost film unit in the pack 10 is transferred into the reception compartment 9 by the rolls 83, which simultaneously cause extrusion and spread of the processing solution 92 through the film unit, and is there pressed against the frame 94 by the pressure plate means 93, whereby the latent image layer 12 thereof is protected from further exposure to light by the walls of the reception compartment 9 and the opaque sheet 4 of the exposed film unit, and image development and transfer and diffusion of image elements are accomplished without risk of formation of unrequired image layer 12 or positive image layer 24. The photographer may view the process of image formation in the positive image layer 24 via the window 92, and so may know rapidly whether or not the photograph has been taken in the desired manner. After completion of photographic processes in the film unit, the film unit may be removed from the compartment 9, or depending on construction of the compartment 9 may be left therein while subsequent film units are exposed. It is to be noted that completed film units removed from the compartment 9 are unaccompanied by sheets, etc., which must be removed and subsqeuently present a problem of disposal, and are liable to become litter. Thus photograph production may proceed in optimum conditions, but there is no need to provide complex camera or film pack means for wind-up, placement or removal of light protection means, for example, such as necessary in conventional means, and the associated camera may have a simple conventional optical system since a completed print carried by the positive image layer 24 is viewed from the opposite side of the film unit to that onto which exposure light is directed, and it is therefore unnecessary for the camera optical system to include image-reversal means. Also since lightproof protection means forming part of film unit construction is necessary on only one side of the latent image layer of the film unit, film unit construction is greatly simplified.

Figure 9:
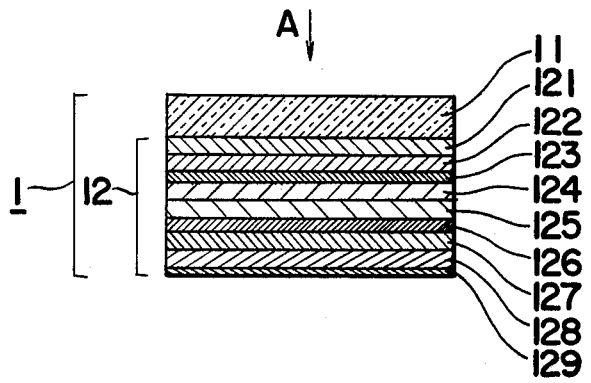
FIG. 9 is a schematic cross-sectional view showing a preferred construction of a photosensitive layer in a film unit.

Referring now to FIG. 9, if the film unit is required to produce colour photographs, the latent image layer 12 attached to the rear of the first transparent support 11 in the first assembly sheet 1 suitably has a construction comprising the following layers in front to rear order: a yellow dye donor layer 121, a layer 122 containing a blue-sensitive silver halide medium, a yellow filter layer 123, a magenta dye donor layer 124, a layer 125 containing a green-sensitive silver halide medium, an intermediate layer 126, a cyan dye donor layer 127, a layer 128 containing a red-sensitive silver halide medium, and a rearmost protective layer 129.

Figure 10:
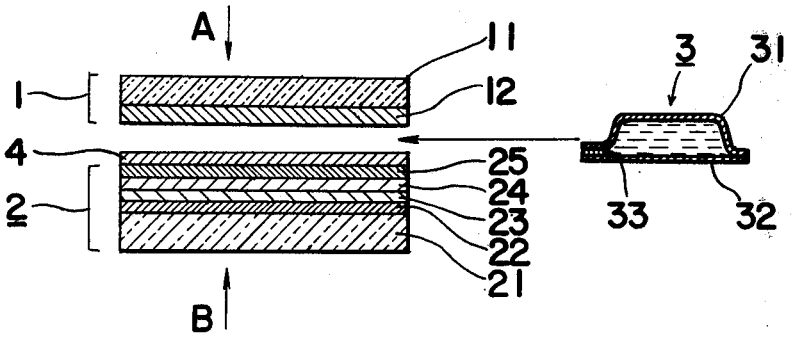
FIG. 10 is a schematic cross-sectional view showing film unit construction according to another embodiment of the invention.

Referring to FIG. 10, in order to provide a suitable white background against which an image formed on the positive image layer 24 may be viewed, the second assembly sheet 2 may include a light-reflection layer 25, which is provided immediately on the forward side of the positive image layer 24, is constituted for example by a layer of polymer substance which is permeable to processing solution and includes a medium such as a titanium dioxide medium. Alternatively, the layer 25 may contain a medium which is not itself reflective of light but may become light-reflecting upon combination with suitable substances included in the processing solution. The neutralization layer 22 suitably contains sufficient acid to neutralize the alkali content of the processing solution, and bring pH in the processing solution and relevant film unit layers to a level suitable for ensuring maintenance of a stable image which is not liable to become discoloured.

Referring to FIG. 11, it it is not required to separate the first assembly sheet 1 from the second assembly sheet 2 subsequent to production of a photograph, the abovementioned support elements 5 and 6 may be replaced by a single support element 100 which is provided around the entire periphery of the film unit which strengthens the film unit structure, defines a leading end portion 101 enclosing and supporting the processing solution container 3 and a trailing end portion 102 enclosing and supporting the excess solution trap 7, and also defines borders 103, 104*a*, 104*b* and 105*a*, 105*b* rast for viewal of an image formed in the positive image layer. To fulfil these functions the support element 100 is preferably made of a composite material and is constituted by a laminate of plastic or paper containing white pigment on paper, opaque polystyrene sheet, i.e., synthetic paper, or aluminimum foil. To ensure good connection of the support element 100 to the rest of the film unit there is suitably applied on inner surface of the support element 100 an adhesive layer or a layer of a thermoplastic bonding agent.

As noted above, the opaque sheet 4, is provided in order to protect photosensitive portions of the film unit from exposure to light other than light reflected from an object to be photographed, and is required to effect such protection until completion of development and other image production processes in the exposed film unit. The degree to which the opaque sheet 4 is able to prevent passage of light may vary, according to the purpose of the film unit and also depending on the sensitivity of the silver halide emulsions in the various photosensitive layers of the film unit, but in general the absorbtivity of the opaque sheet 4 should be at least 5, and preferably more than 7, with respect to the entire radiation waveband including radiation in the ultraviolet visible light, and near infrared region, and the sheet 4 should be particularly absorptive of radiation in the 300 to 750 millimicron waveband. The sheet 4 may also serve to provide a background for viewing of the photographic image produced in the positive image layer 24 as well as serving to protect the latent image layer 12 from unrequired exposure to light. In this case, the sheet 4 suitably comprises a layer which is provided nearest to the positive image layer 24, is permeable to an alkali solution, and contains a light-reflection agent such as titanium dioxide or zinc sulfate, and a layer of polymer material such as gelatine or polyvinyl which permits passage of processing this layer being provided on the side of the sheet 4 which is further removed from the positive image layer 24, and including a light-absorptive substance, e.g. carbon black.

As well as carbon black, substances which may be usefully employed to effect absorption of light include pigments or dyes, including durect dyes and acid dyes, metallic salts such as silver sulfide, or a metal in a colloidal state, e.g., colloidal silver. Alternatively there may be employed dyes such as disclosed in U.S. Pat. No. 3,647,437 and Japanese Patent Publication No. 47-28, or a pH indicator dye of the type which is conventionally known in the field of analytical chemistry and which is effectively colorless when the pH value thereof is lower than the pKa value thereof and becomes coloured when the pH value thereof becomes equal to or higher than the pKa value thereof, such substances being provided in an alkali processing solution, and hence in an initially coloured form or may be provided in an initially colourless state and coated on the surface of the latent image layer and/or the positive image layer.

Another procedure which may be followed is to include in the processing solution coloring material which is known to reduce sensitivity of a photosensitive silver halide material, which procedure has the advantage that the opaque sheet 4 may be less absorptive of light and so may have a simpler composition.

Thus, as noted above, the latent image layer 12 of an exposed film unit may be protected on one side by the opaque sheet 4 and on the other side by the walls of the reception compartment 9 into which the exposed film unit is inserted. After a certain time such protection of the latent image layer 12 may be removed, since, for practical purposes, photographic processes in the film unit are terminated, and exposure of the latent image layer 12 to external light is not liable to result in any normally discernible fogging or similar effects. Since the time required for photographic processes to be effectively completed in the film unit is known, it is convenient to include in an associated camera timer means which are actuated simultaneously with processing rolls, for example, and which actuate an indication means such as a small lamp or buzzer after a time sufficient for a film unit to have been passed through the processing rolls and inserted into the reception compartment, and for development and image diffusion and transfer to have been completed, whereby the photographer may know when the film unit may be removed from the reception compartment.

The length of time an exposed film unit is required to be kept in the reception compartment, i.e., approximately, necessary processing time, is evidently dependent on factors such as sensitivity of and speed of image development in the latent image layer of the film unit, the degree to which processing solution and the 1st assembly sheet as a whole or the 1st transparent support therein are able to prevent passage of light, or the hydrogen ion concentration (pH) of the latent image layer after spread of processing solution thereto. It is of course desirable to keep processing time as short as possible, and to achieve this it is useful to include in the processing solution conventionally known colouring matter such as pina-krypto-yellow, methylene blue, or phenazine which are known to be able to reduce sensitivity of a silver halide photosensitive material.

Reduction of processing time may also be effected by incorporation in the film unit of a transparent neutralization layer, such as layer 22 of FIG. 10, which contains a sufficient amount of acid to neutralize alkaline substances present in the processing soluton after a time sufficient for required photographic processes in the film unit have been completed, thus reducing pH of the processing solution to a level at which action of the processing solution ceases, and resulting in production of a stable photographic image.

The transparent supports employed in the film unit of the invention are made of material which is able to maintain good flatness and is not subject to undue dimensional change with time or under the influence of processing solution. These objects may be achieved by employing a rigid support material such as glass, but from the point of view of maneuverability of a film unit within a camera it is preferable to employ a material which has the above-noted characteristics but is also flexible. Suitable flexible support materials include cellulose intrate film, cellulose acetate film, polyvinyl acetal film, polystyrene film, and polycarbonate, for example. A particularly suitable type of support is one which as well as being dimensionally stable is also relatively impermeable to oxygen, in order to ensure maintenance of stable colour elements and minimum staining of a completed photograph, an example of this type support being a laminate consisting of a polyvinyl alcohol layer between layers of material such as polyethylene terephthalate or cellulose acetate. Another type of support which may be advantageously employed is a support such as disclosed in U.S. Pat. No. 3,573,044 which is permeable to water vapour, and so facilitates passage to the film unit exterior and evaporation of water content of the processing solution. Preferably, in order to prevent the possibility of external light passing through edge portions of the transparent supports and impinging on the silver halide emulsion layer or layers during processing of the film unit in a light location, border portions of the transparent supports are made coloured, or have applied on one surface thereof an agent for prevention of light, these lightproof edge portions of the transparent supports being so disposed that they prevent no hindrance to exposure of the latent image layer or to viewal of a completed photograph. If required one or both the transparent supports may include a plasticizer such as an ester of photophoric acid or of phthalic acid, an absorbent of ultraviolet radiation, such as α-(2-hydroxy-4-t-butyl phenyl) benztriazole, or an anti-oxidation agent such as hindered phenol. To maintain bonding of a support to an adjacent layer containing a hydrophilic polymer the contact side of the support may receive an undercoat of bonding agent or the surface of the support may receive preliminary treatment such as exposure to corona discharge, irradiation with ultraviolet rays, or flame treatment. The thickness of each transparent support is suitably of the order of 20 to 300 microns.

As noted above, the processing solution container is provided at a leading edge portion of the film unit, in a position to permit processing solution to be extruded therefrom and spread through the film unit is passed through pressure means. Numerous types of processing solution container may be employed, but the container preferably employed is made of a flexible material which is impermeable to alkali and to air, does not affect properties of processing solution contained therein, may define different shapes but normally defines a generally cubic container, when processing solution is held therein, and has inside edge portions evenly bonded by a weak bonding means whereby processing solution may be extruded in an even layer upon application of external pressure on the film unit, examples of such containers suitable for employment in the film unit of the invention being disclosed in U.S. Pat. No. 2,530,306, No. 2,750,075, and No. 3,152,515, Japanese Patent Publication No. 38-3,744, U.S. Pat. No. 3,221,942, No. 3,603,230, and Japanese Patent Publications No. 49-18,262, and No. 48-36,895.

Various types of material may be employed for construction of the processing solution container, but there is preferably employed a material such as described in U.S. Pat. No. 2,634,886, No. 2,653,732, No. 2,653,888, No. 2,723,051, No. 3,056,491, No. 3,056,492, No. 3,173,580, and No. 3,649,282, according to which there is provided a laminate construction consisting of metal foil, of lead, aluminium or other metal impermeable to gas, and a plastic film, for example of polyvinyl chloride, which does not permit passage of alkali and has no effect on processing solutio. Weak bonding of inside edges of effected by various known techniques, including techniques described in the abovecited patents, one example of an effective method being the provision in stripe form, along the bonded edges of the container material, of a layer of material such as a copolymer of acrylonitrile, and vinyl chloride, which weakens adhesion.

To ensure spreading of processing solution in a layer of requisite thickness between the first assembly sheet and second assembly sheet there is suitably provided a spacer along each side of the film unit. Each spacer may be provided completely between the first and second sheets, or at least one of the spacers may be positioned along the outer edge of one or both of the sheets. In the latter case the spacer is able to stretch to a maximum distance equal to the required thickness of the layer of processing solution in the film unit. Whatever the arrangement of spacers, the spacers are so selected that the resulting thickness of the layer of processing solution is of the order of 10 to 400 microns, and preferably in the range 20 to 200 microns.

If the spacers are provided actually between the first assembly sheet and second assembly sheet, a space is defined between the sheets prior to spread of processing solution therebetween, and this space contains air which could be the cause of Newton's rings or other forms of optical interference when the film unit is exposed, and may also result in production of air bubbles in processing solution spread through the film unit, and consequently of areas in which action of the processing solution is rendered less effective. The former problem is minimized, since the latent image layer which is initially exposed to image-wise light is provided on the forward side of this space, and the latter problem may be countered by providing along the trailing edge portions of the first and second sheets a weakly bonded laminate construction having component layers which may be separated due to pressure imposed thereon due to compression of the air in the space between the first and second assembly sheets by processing solution being spread through the film unit, whereby this air is allowed to escape.

To ensure effective production of a layer of processing solution of requisite thickness it is advantageous to initially provide in the processing solution container processing solution to an amount which occupies a volume greater than the volume of the space defined, or subsequently definable, between the first and second sheets, the amount of solution being suitably such as to occupy a space 1.05 to 2.5 times the volume of this space. Since processing solution is alkaline and could be harmful to a user if allowed to leak out of the film unit, there is preferably provided means for retaining excess processing solution in the film unit, such means being suitably constituted by a which is trap made of material having a honeycomb, fibrous, or porous construction. It is also useful to employ a processing solution trap means such as disclosed in Japanese Patent Publication No. 42-7,824, which further acts to neutralize the excess processing solution.

The trap have various forms and be mounted according to various known techniques such as disclosed in Japanese Patent Publications No. 48-33,699, No. 48-33,700, No. 48-38,401, No. 49-1205, No. 49-4331, No. 49-4332, No. 49-2615, No. 48-43,317, No. 46-7784, and No. 48-37,130, for example.

The pressure means employed in associated with the film unit of the invention in order to effect spreading of processing solution through the film unit are suitably means comprising a pair of pressure elements which are elastically urged towards one another, such as disclosed in Japanese Patent Publications No. 39-26,444, No. 45-35,160, No. 47-1837, No. 47-37,928, No. 36-3091, No. 36-10,389, No. 40-23,631, No. 45-16,754, No. 45-30,301, No. 46-13,476, and No. 46-13,475, U.S. Pat. No. 3,647,441, No. 3,766,842, No. 3,742,834, Japanese Patent Publication No. 47-1,837, U.S. Pat. No. 3,537,371, and No. 3,652,281, and Japanese Patent Publication No. 48-19,214. The pressure elements employed may be in the form of plates, bars, or rotatary rolls, and may be combined in various ways, i.e., the pressure means may consist of a pair of plates, a pair of rollers, or one element thereof may be a roller and the other a bar or plate, for example. The pressure elements may be made of a hard material such as metal, or an elastic material such as rubber, or may be constituted by metal coated with rubber, thus providing a suitable combination of hardness and elasticity. To ensure spreading of processing in a required manner through the film unit the pressure elements should be elastically held at a certain set distance from one another, this distance being uniform over the whole length of the pressure elements, or being smaller over a central portion of the pressure elements than over end portions thereof.

Application of the various Photographic layers of the film unit may be effected by dip, roller, or air knife method, by the bead coating method disclosed in U.S. Pat. No. 2,681,294, or by the curtain method disclosed in U.S. Pat. No. 3,508,947 and No. 3,513,017. A particularly advantageous method of application of photographic layers including colour donor elments, is the method which permits simultaneous application of a plurality of layers of employing the so-called slit hoppers, such as disclosed in U.S. Pat. No. 2,761,417, No. 2,761,418, No. 2,761,419, and No. 2,761, 791.

Application of photographic layers is rendered easier if the receiving surface, i.e. the sheets on which the photographic layers are to be applied are preliminary coated with one or more surfactants acting as coating assistants. Examples of coating assistants which may be employed to advantage are saponin, an exi-ethylene addition compound of p-nonyl phenol, an alkyl ether of canesugar, an non-ionic surfactant such as a mono-alkyl ether of glycerine, an anionic surfactant such as dodecyl sodium sulphate, p-dodecyl benzene sodium sulfonate, or dioctyl sodium sulfosuccinate, or an amphoteric surfactant such as carboxy methyl dimethyl lauryl ammonium-hydroxide internal salt, the product manufactured by and sold under the trade name of "Deriphat 151", or the betaine amphoteric surfactants disclosed in U.S. Pat. No. 3,411,413, U.K. Pat. No. 1,159,825, and Japanese Patent Publication No. 46-21,985.

Application of a photographic layer may also be rendered easier by inclusion of a viscosity improver in the receiving surface. The viscosity improver employed may be one which is itself inherently viscous and so improves viscosity of the receiving surface, for example a high polymer such as a polyacrylamide, or an anionic polymer which acts to improve viscosity in combination with a bonding polymer in the receiving surface material, examples of the latter type of viscosity improver being the acryl acid polymer disclosed in U.S. Pat. No. 3,655,407, a cellulose sulfuric acid ester, or a poly-p-sulfostyrene potassium salt.

The silver halide medium employed in the film unit has a composition selected with respect to the intended use of the photosensitive material as well as to processing conditions, and is suitably a colloidal dispersion of silver chloride, silver bromide, silver iodo-bromide, silver iodide, silver chloroiodobromide, or a mixture of these substances. A particularly preferable medium is a silver iodobromide and silver chloroiodobromide in which the proportion of iodide is 1 mol% to 10 mol%, the proportion of chloride is less than 30%, and the remainder is a bromide. Average grain diameter would be approximately in the range of 0.1 to 2 microns, and grains should have closely equal diameters to permit formation of good images in the photosensitive material. The grains may be cubic or octohedral, or may have various other crystalline configurations. Such silver halide media may be produced by the methods which are disclosed in Chapters 18–23 of "Chimie Photographique" (2nd Edition, 1957; Paul Montel, Paris) by P. Glafkides, and according to which a soluble silver salt such as silver nitrate and a water soluble halide such as potassium bromide are caused to react in a protective colloidal solution, of gelatine for example, and crystals are produced in the presence of excess halide or a solvent of silver halide such as ammonia. During this process it is possible to effect precipitation by the single or double jet method, or by the pAg control double jet method. Removal of soluble bases from the emuslion may be effected by procedures such as dialysis or water-washing of the cooled and solidified emulsion, or by precipitation through adjustment of the pH of the emulsion by addition of a precipitant such as an anionic surfactant or an anionic polymer containing a sulfone group, sulfuric acid ester group, or caboxyl group, or by use of an acylated albumen substance, such as phthalyl gelatine, acting as a protective colloid. Preferably, the chemical sensitivity of the silver halide emulsion is increased by heat treatment thereof together with a combination of various sensitizers including, for example, a natural sensitizer contained in gelatine, a sulfur sensitizer such as sodium thiosulfate or N,N,N'-trimethyl thiourea, a metal sensitizer such as thiocyanate or thiosulfate formed from a monovalent metal, and a reduction sensitizer such as stannous chloride or hexamethylene-tetramine. The film unit may equally employ an emulsion permitting easy formulation of a latent image on surfaces of the grains of the emulsion, or an emulsion such as disclosed in U.S. Pat. No. 2,592,550 or No. 3,206,313 wherein a latent image is formed more easily in the interior of grains of the emulsion.

The silver halide emulsion may be stablized by means of an additive such as 4-hydroxy-6-methyl-1,3,3a,7-tetrazaindene, 5-nitro-imidazole, 1-phenyl-5-mercaptotetrazole, 8 chloro-mercury-quinoline, benzene sulfonic acid, or pyrocatechin. Other suitable stabilizers that may be employed are inorganic compounds in the form of complex salts of elements of the platinum group, for example the chloro-salt of palladium, a mercury salt, and a cadmium salt. When such stabilizers are employed the silver halide emulsion suitably includes a sensitization compound such as polyethylene oxide.

Increased colour-sensitivity may be imparted to the silver halide emulsion by means of colouring matter which also acts to increase photochemical activity. Suitable photochemical sensitization agents that may be cited include cyanines in general, melocyanines, holopolar cyanines, styryls, hemicyanilines, oxanols, and hemioxanols, specific examples of such agents being given in Chapters 35–41 of the abovecited work by P. Glafkides and in "The Cyanine Dyes and Related Compounds" (Interscience) by F. M. Hammer. Compounds particularly suited to the film unit of the invention are cyanines in which nuclear nitrogen atoms are replaceable by aliphatic groups including hydroxyl, carboxyl, or sulfone groups such as disclosed in U.S. Pat. No. 2,503,766, No. 3,459,553, and No. 3,177,210, for example.

Bonding between the silver halide layer, the layer including dye-developer material, and auxiliary layer or layers, such as a protective layer, intermediate layer, or other layers, which are permeable to processing solution, is afforded by a hydrophilic polymer including gelatine, casein, gelatine which has been improved by an acylation agent, an albumen such as gelatine albumen grafted by a vinyl polymer, a cellulose derivative such as hydroxy ethylcellulose, methylcellulose, or carboxy methylcellulose, a partial hydrolysate of polyvinyl alcohol or polyvicyl acetate, pyrivinyl pyrolidon, a high polymer non-electrolyte such as polyacrylamide, polyacrylic acid, a partial hydrolysate of polyacrylamide, a synthetic polymer with arrilic characteristics such as a copolymer of vinyl ethyl ether and maleic acid, or an amphoteric hydrolytic synthetic polymer such as a polyacrylamide obtained by a Hofman reaction process and a copolymer of N-vinyl imadazole, acrylic acid and an acrylamide. These hydrophilic polymers may be used alone or mixed, and layer constituted by one such polymer or polymers may also include a dispersoid, in latex form, for example, constituted by polymerized acryl acrylate, acryl methacrylate, or other hydrophobic monomers. These hydrophobic polymers, particularly polymers containing functional groups such as the amino group, hydroxyl group, or carboxyl group, may be rendered insoluble, while still remaining permeable to processing solution, by means of various types of cross-linking agents. Cross-linking agents which are particularly suited to this purpose are formaldehyde, glyoxal, glutal aldehyde, mucochloric acid, an aldehyde compound such as an acrylein olygomer, an aziridine compound such as the triethylene phosphamide disclosed in Japanese Patent Publication No. 37-8,790, an activated compound such as the 1,4-bis(2',3'-epoxy propoxy)diethyl ether disclosed in Japanese Patent Publication No. 34-7,133, and activated halogen compound such as the 2-hydroxyl-4,6-trichloro-S-triazene sodium salt disclosed in U.S. Pat. No. 3,325,287, an activated olefin compound such as hexahydro-1,3,5-triacrylyl-S-triazine, a methylol compound such as N-polymethylol urea or hexamethylol melamine, or a high polymeric substance such as the gelatine treated with 3-hydroxyl-5-chloro-S-azinyl which is disclosed in U.S. Pat. No. 3,362,827. As well as a cross-linking agent or agents the hydrophilic polymer layer or layers may also include a linking reaction promoter such as carbonate or resorcinol.

The image-formation material of the film unit is a dye-developer material if it is required to produce a coloured photograph, and a compound of a complex salt or salts of silver if it is required to produce a black and white photograph. Alternatively there may provided two or more colour-image donor materials, as disclosed in Japanese Patent Publication No. 47-3479, in order to produce a black and white photograph.

The dye-developer material is a compound permitting secondary distrinution of diffusable colouring matter in a pattern corresponding to the latent image formed in the silver halide emulsion due to exposure thereof to image-wise light. Various types of dye-developer material may be employed for causing production of diffusable colouring elements in response to the image of the silver halide emulsion, examples being as follows, (1) a type wherein colour elements become diffusable as a result of oxidation of the dye-developer material by silver halides; (2) a type wherein diffusable colour elements are emitted upon reaction of the dye-developer material with products oxidized by silver halides; (3) a type wherein diffusable colour elements are emitted upon reaction of the oxidized dye-developer material with an auxiliary chemical agent. In addition to such types, wherein oxidation by silver halides is directly connected to donation of diffusable colour elements, there may also be employed types according to which excess material not used in development or subsequent reaction serves as the basis for or initiator of formation of diffusable colour elements, for example, (4) a type according to which a limited amount of developer is employed and excess developer not used in development is moved to the positive image layer where it is changed to colouring matter; (5) a type according to which a limited amount of developer is employed and excess developer not used in development is caused to react with the dye-developer material, this reaction resulting in donation of diffusable colour elements; (6) a type according to which there is provided a limited amount of coupler or other active species for reaction with oxidation products of developing solution, and, after development, excess coupler which was not used in a reaction with the oxidized developer is moved to the positive image layer where it is converted to colouring matter; (7) a type according to which silver ions obtained from silver halides which were not used in the development process are caused to react with the dye-developer material thereby producing diffusable colour elements; in addition there may also be employed (8) a type according to which as a result of development of silver halide grains mordant is formed around the grains or broken down, whereby diffusable colour elements are fixed or liberated.

The colour-image donor material may have a complete colour structure portion incorporated therein initially, i.e., at initial production of the film unit for colour photography, or the colour structure portion may be formed during development and the simultaneously occurring post-treatment process. Alternatively, necessary components may form the colour structure portion after being moved to the positive image layer.

The colour-image donor material should be non-diffusable in photosensitive elements during the stages of production, storage, and exposure of the photosensitive material. The donor material or elements thereof may be diffusable in various modes, according to the manner of formation and distribution of the coloured image during the stage of development and of diffusion transfer. For example, according to one type of colour-image donor material, the material is soluble and diffusable in processing solution, but becomes less diffusable and is fixed as a result of image-development, and the colour-image donor portions which are not developed are transferred to the positive image layer. According to another type, the colour-image donor material is not itself diffusable in processing solution but produces diffusable colour elements or diffusable colour element drives as a result of development.

As noted above, according to the invention production of colour elements subsequent to, and in response to, development is achieved by a colour structure formation stage and various combinations of diffusable colour-image material. However, it has been found particularly advantageous in the film unit of the invention to effect production of colour elements as follows.

(a) The colour-image donor material is constituted by a compound such as disclosed in U.S. Pat. No. 2,983,606, each molecule of which combines a colour structure and a group of silver halide development agent. In this case, reaction of a colour development agent and alkali in the exposed silver halide emulsion results in oxidation of the colour development agent and reduction of silver halides. Compared with reduction-type primary colour element development agent, oxidized colour development agent has low solubility and diffusibility in processing solution, and is fixed in the vicinity of reduced siliver halides. In the preferred form, the colour development agent should be effectively insoluble in an acidic or neutral aqueous medium, but should include at least one disassociable residual group which is sufficient to render the colour development agent soluble and diffusable in a processing solution constituting an alkaline substance. Such a colour development agent may be incorporated in a silver halide emulsion layer, or in a film unit layer adjacent thereto, and it is possible to obtain a coloured positive print in a single development and processing action by combining the silver halide emulsion with a colour development agent which is able to absorb light in the waveband over which the silver halide emulsion is sensitive to light directed thereon, in order to produce photosensitive elements which are each constituted by two or more component photosensitive units each such composite colour element being diffused and transferred to one element of the positive image layer. To render the colour development agent absorptive of light it is useful to employ means for subtractive colour process and colour rendering, the colours concerned being yellow, magenta and cyan, such absorption of light of wavelengths corresponding to these colours being achievable by incorporation in the colour structure portion of suitable dyes, for example azo dyes, anthraquinone dye, phthalocyanine dye, nitro dyes, quinoline dye, azomethene dye, indamine dye, indoaniline dye, indophenol dye, and azine dye. The silver halide developer group is representative of a grooup which is able to cause production of silver halides under the influence of light, and is preferably also a member of a group which causes a loss of affinity for water as a result of oxidation. A suitable group to meet these requirements is a benzenoid developer group, i.e., developer constituted by an aromatic group which forms a quinoid upon being oxidized. A preferred developer group is the hydroquinonyl group, although the orthodihydroxypheneyl group, and the ortho- or para-amine substituted hydroxy-phenyl group, for example, are also suitable. The colour structure portion and the developer group of the preferred colour developer are separated by a saturated aliphatic group such as ethylene, in order to prevent electron sharing thereby, grooups particularly suited to this purpose being the 2-hydroxy phenyl ether group and the 2-hydroquinonyl propyl group. As well as being combined by covalent bonds, the colour structure portion and the developer group may also be combined by coordinate bonds as in the material described in U.S. Pat. No. 3,551,406, No. 3,563,739, No. 3,597,200, and No. 3,674,478. Further, depending on the purpose and structure of the colour film material, it may be advantageous to temporarily convert the colour structure portion to a colourless leuco-type material by reduction thereof, in the manner disclosed in U.S. Pat. No. 3,320,063, or to temporarily move the absorption range thereof to the short wave side by acylation of the an auxochrone in the form of a hydroxyl group or amino group, in the manner disclosed in U.S. Pat. No. 3,230,085 and No. 3,307,947. Also, a colour developer having a colour structure portion in which the ortho positions of azo bonds are occupied by hydroxyl groups, as disclosed in U.S. Pat. No. 3,299,041, presents the advantages of better absorption characteristics and improved stability of the colour image. Other examples of colour developers are disclosed in U.S. Pat. No. 2,983,605, No. 2,992,106, No. 3,047,386, No. 3,706,808, No. 3,067,820, No. 3,077,402, No. 3,126,280, No. 3,131,061, No. 3,134,762, No. 3,134,765, No. 3,135,604, No. 3,136,605, No. 3,135,606, No. 3,135,734, No. 3,141,722, No. 3,142,565, No. 3,173,906, No. 3,183,090, No. 3,246,985, No. 3,230,086, No. 3,309,199, No. 3,230,083, No. 3,239,339, No. 3,347,762, No. 3,347,673, No. 3,245,790, and No. 3,230,082.

Specific examples of suitable colour developer which may be cited are as follows.

4-[p-(β-hydroquinol ethyl)phenyl azo]-3-(N-n-hexicarbomoyl)-1-phenyl-5-pyrazone

2-[p-(β-hydroquinoyl ethyl)phenyl azo]-4-isopropoxy-1-naphthol
1,4-bis-[β-(hydroxyquinoyl-α-methyl)ethylamino]-5,8-dihydroxy anthraquinone,
these substances having the following structures
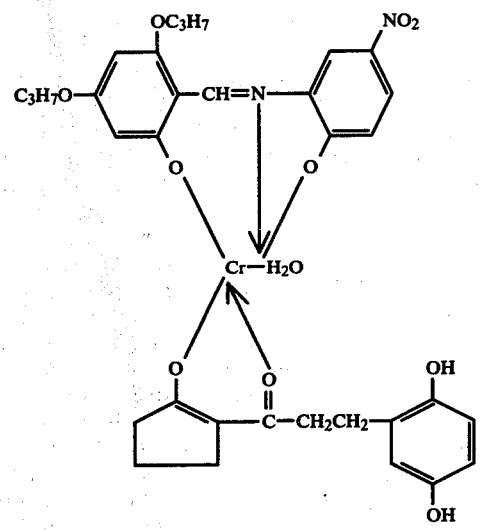
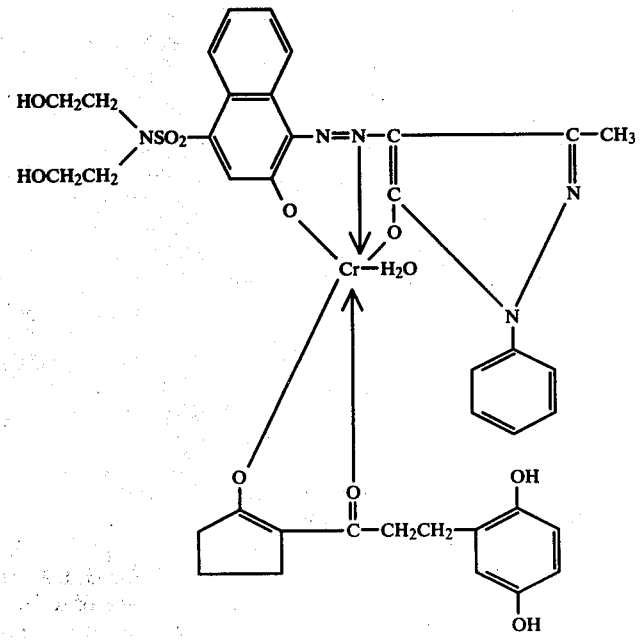

-continued

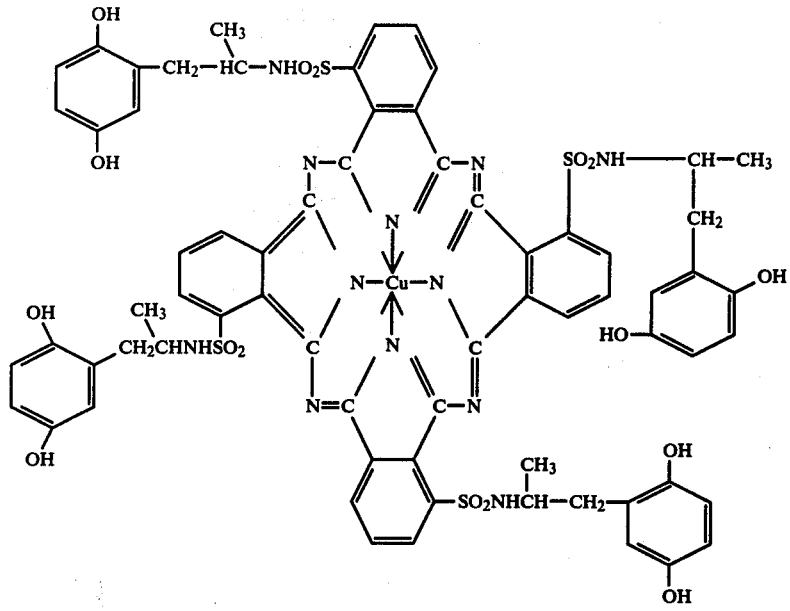

In order to increase speed of development of a diffusion-transfer type colour photograph when the colour developer is used as the colour image doner material, it is useful to employ an auxiliary developer. To meet this purpose there may be employed for example a catechol derivative, a hydroquinone derivative such as 4'-methyl phenyl hydroquinone or t-butyl hydroquinone, or a developer such as the 1-phenyl-3-pyrazolidone developer disclosed in U.S. Pat. No. 3,039,869, these substances being provided in a liquid processing solution, or being included in photosensitive material, in particular in the silver halide emulsion layer, in the layer containing the colour developer, in an intermediate layer, or in the upmost protective layer. Together with such a substance there may also be provided an onium compound such as N-benzyl-α-picolium bromide, which is disclosed in U.S. Pat. No. 3,173,786, and which acts to promote advance of development and of image diffusion and transfer.

(b) The coupler should be reactive, non-diffusible compound which is able to cause a coupling reaction with the oxidized principal developer and to cause release and emission of soluble and diffusible colouring matter in the processing solution as a result of this coupling reaction. The first type of compound considered suitable for effecting emission of diffusible colouring matter in the film unit of the invention includes a structure portion which is substituted by residual groups released by the oxidized principal developer at the point of the coupling reaction. The electron sharing system in the emitted colouring matter may be incorporated beforehand in the coupler, which in this case may be called a 'preformation type', or may be formed when the coupling reaction takes place, in which case the coupling may be called an 'immediate formation type'. Preformation type coupler has an absorption spectrum close to that of the emitted colouring matter, whereas the immediate formation type is generally colourless, or if it is coloured its absorption of particular wavelengths is only temporary and is not directly connected to absorption by emitted colouring matter.

Typical examples of couplers for emission of diffusible colouring matter may be represented by the following formulae.

(1) (Cp-1)-L-(Fr) (preformation type) and (2) (Cp-2)-L-(Bl), components having the meanings noted below. Cp-1 represents a coupling reactive structure portion in which the coupling position groups are substituted by (Fr)-L residual groups, and of which at least one of the groups at a non-coupling position may be substituted by a group able to impart diffusion nesistance to couple molecules including a hydrophobic base of one or more carbon atoms. Cp-2 represents a coupling reactive structure portion in which groups at coupling positions substituted by (Bl)-L residual groups. When employed in combination with a principal developer which does not have a water soluble group or groups the Cp-2 groups include at least one water-soluble group at non-coupling position.

(Fr)-L and (Bl)-L represent groups which are released by the oxidized developer. More particularly, Fr represents a colour structure portion which is able to absorb light in the visible wavelength and includes at least one water-soluble group, and Bl represents groups which include a group or groups of light or more carbon atoms, and are able to impart non-diffusibility to coupler molecules. Many functional groups known to be able to effect oxidation coupling of aromatic group 1st order amines and colour may be cited as employable for Cp-1 and Cp-2, examples being phenols, anilines, ring or chain active methylene compounds, or hydrazones. More specific examples of reactive structure portions which are particularly suitable include phenol having substitution acyl-amine groups, 1-hydroxyl-2-amido naphthenic acid, N,N-dialkyl aniline, 1-aryl-5-pyrazolone in which the third position is substituted by an alkyl, aryl, alkoxy, aryloxy, amine, acyl amine, ureide, or sulfone amide group, pyrazobenzo-imidazole, pyrazo-triazole, α-cyanoacetophenone, or a derivative of acylaceto-aniline.

Examples of the combination group L whose bond with the coupler structure portion is broken under the influence of oxidized developer include the azo group, azo-oxy group, mercury group (—Hg—), oxy-group, thio-group, dithio group triazolyl group, diazolyl amine group, acyl sulfone amine group

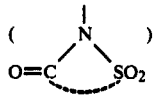

acyl-oxy group, sulphonyl-oxy group, and alkyldene group. Among these substances, the oxy, thio, dithio, diacyl amine, acyloxy and similar groups, which break away as anions, are particularly useful since they result in production of a large amount of diffusible colouring matter. It is preferable that the coupling position groups of phenol or naphthol coupling structure portions be replaced by groups bonded by oxy, thio or diacyloxy groups, those of pyrazone coupling structure portions by azo, thio, or acyloxy groups, and those of acylacetoanilide coupling structure portions by oxy, thio, or diacylamine groups.

Representative examples of Fr colour structure portions include azo dye, azo-methene dye, indoaniline dye, indophenol dye, anthraquinone dye, nitro dye, and azone dye.

Hydrophobic residual groups included in the residual groups represented by Cp-1 and Bl should be non-diffusable in a hydrophilic colloid constituting a photosensitive material, and impart to coupler molecules the ability to aggregate in an aqueous medium. Suitable hydrophobic residual groups include alkyl aryl groups, aryl alkyl groups alkenyl groups, or alkyl groups which are non-substitional or in which eight or more carbons are replaced, examples of such groups being the lauryl, stearyl, oleyl, 3-n-pentadecyl phenol, and 2,4-di-t-amyl phenyl groups. These hydrophilic groups are linked to the coupling base structure portion, either directly or by a bivalent bond such as an amide, ureide, ether, ester, or sulfone amide bond, and so constitute the Cp-1 material. These hydrophilic residual groups may also constitute the Bl material by being linked to a residual group such as an aryl group or hetero ring group, either independently or through one of the abovementioned bivalent bonds.

Water-soluble groups included in the residual groups represented by Cp-2 and Fr are promoter bases which donate acid groups which are effectively dissociated in the processing solution, or contribute acid groups under the effect of hydrolysis. Particularly useful acid groups are groups with a pKa of 11 or less, examples of such groups being sulfo-, sulfuric ester (—O—$SO_3H$), carboxyl, sulfamide, diacyl amide, cyanosulfamide, and phenolic hydroxide groups.

Upon reaction of coupler of the type represented by the general formula (1) above with oxidized developer, the L bond is broken, and there is formed a soluble colouring matter containing the Fr structure portion and a non-diffusible condensation product of Cp-1 and the developer. This soluble colouring matter is diffused to the positive image layer, where it forms a colour image.

Upon reaction of coupler represented by the general formula (2) above with oxidized developer, the L bond is broken, and there is obtained a non-diffusible released product which is derived from Bl-1- and soluble colouring matter constituted by an oxidation coupling product of Cp-2 and the developer. The soluble colouring matter is diffused to the positive image layer, where it forms a colour image.

Specific examples of coupler for production of diffusible colouring matter and having a type (1) structure are as follows.

a-[4-(8-acetoamide-3,6-disulfo-1-hydroxy-2-naphthyl azo)-phenoxy]-a-pivalyl-4-(N-methyl-N-octodecyl sulfamyl) acetoanilide bisodium salt.

1-(p-t-butyl phenoxy phenyl)-3-[a-(4-t-butyl phenoxy)-proprionamide]4-(2-bromo-4-methylamide-5-sulfo-1-anthra-9,10-quinalyl-azo)-5-pyrazone, 1-hydroxy-4-{3-[4-(N-ethyl-N-sulfoethylamine)-2-methyl-phenylazo]phenylazo}-N-[8-(2,4-di-t-amyl phenoxy) butyl]2-naphtha amide sodium salt.

Specific examples of coupler represented by the above noted general formula (2) are as follows:

α-(4-metoxy benzoyl)-a-(3-octadecyl carbamyl phenyl thio)-3,5-dicarboxy aceto anilide, α-pivalyl-α-(3-octadecyl carbamyl phenyl thio)-4-sulfo-acetoanilide potassium salt, 1-phenyl-3-(3,5-dicarboxy aniline)-4-(3octadecyl carbamyl-phenyl thio)-5-pyrazone, 1-phenyl-3-(3,5-disulfobenzyl amine)-5-(2-hydroxy-4-n-pentadecyl phenyl azo)-S-pyrazone, 1-[4-(3,5-dicarboxy benzamide) phenyl]-3-ethoxy-4-(3-octadecyl carbamyl thio)-5-pyrazone, 1-hydroxy-4-(3-octadecyl carbamyl phenyl thio)-N-ethyl-3',5'-dicarboxy-2-naphtha anilide, 1-hydroxy-4-(n-octadecyl succinamide)-N-ethyl-3,',5'-dicarboxy-2-naphtha anilide.

Specific examples and methods of production of suitable coupler for emission of diffusible colouring matter are disclosed in U.K. Pat. No. 840,731, No. 904,364, and No. 1,085,631, and U.S. Pat. No. 3,476,563, No. 3,644,498, and No. 3,419,391.

When a compound of the 2nd type of coupler is employed there is a continued reaction which follows the condensation reaction with oxidized developer, and in which there is a closed ring reaction between molecules of substitution groups in neighbouring positions at the reaction point, this closed ring reaction being accompanied by break-up and release of residual colour bases. A particularly advantageous reaction is that in which after developer constituted by an aromatic group first order amine has been oxidation coupled to the fourth positions of phenol or aniline, azine rings are formed between sulfonamide bases containing colour structure portions located in the third positions thereof, and difusible colouring matter including sulfonic acid is released. Specific examples of compounds for accomplishing such a reaction include 1-phenyl-3-ethyl carbamyl-4-{2-methoxy-4-[N-n-dodecyl-N-(1-hydroxy-4-chloro-3-naphthyl)]sulfamoyl phenyl azo}-5-pyrazone 2-(β-octadecyl carbamyl ethyl)-4-{2-4-(2-hydroxy-1-naphthyl azo) phenyl sulfamide-aniline}phenol.

It is advantageous if the aromatic group 1st order amine constituting developer employed in combination with a coupler for emission of diffusible colouring matter is p-amino phenol or p-phenylene diamine, or derivatives thereof. Substances which are particularly suitable include 2-chloro-4-amino phenol, 2,6-diprolo-4-amino phenyl, 4-amine-N,N-diethyl-3-methyl aniline, N,N-diethyl p-phenylene diamine, N-ethyl-β-methane sulfo amido ethyl-3-methyl-4-amino aniline, 4-amino-N-ethyl-N(δ-sulfo butyl)-aniline, 4-amino-N-ethyl-N-(β-hydroxy ethyl) aniline, 4-amino-3-methyl-N-ethyl-N-(β-hydroxyl ethyl) aniline, 4-amino-N-ethyl-N-(β-carboxy ethyl) aniline, 4-amino-N,N-bis(β-hydroxy ethyl)-3-methyl-aniline, 3-acetamide-4-amino-N,N-(β-hydroxy ethyl) aniline, 4-amino-N-ethyl-N-(2,3-dihydroxy propyl)-3-methyl aniline, 4-amino-N,N-diethyl-3-(3-hydroxy propoxy) aniline, 4-amino-N-ethyl-N-(β-hydroxy ethyl)-3-methoxy aniline, hydrochloric, sulfuric or similar acids of these anilines, and salts of p-toluene sulfone or similar acids. In addition it is advantageous to add to the photosensitive material development accelerator such as Schiff bases of the various anilines noted above or amidophthalin acid.

A negative silver halide emulsion containing a coupler such as noted above gives a negative, diffused and transferred colour image as a result of development processing, whereas a direct positive type silver halide emulsion containing the coupler gives a positive image. Effective directive positive type emulsions described in U.S. Pat. No. 2,592,250, No. 2,588,982, and No. 3,227,552, or of the coupler setter type such as described in U.K. Pat. No. 443,245, and No. 462,730, and U.S. Pat. No. 2,005,837, No. 2,541,472, and No. 3,367,778. A positive, diffusion-transfer colour image may be obtained by utilizing a developer solution containing a silver halide medium to process a layer which contains physical nuclei for image formation and a coupler for release of diffusible colouring matter, and is provided immediately adjacent to a layer of negative type silver halide emulsion. In this case there may be employed the technique for reversal colour image formation which makes use of such physical nuclei, as disclosed in U.K. Pat. No. 3,227,554, and No. 3,364,022 and D.F.R. Pat. No. 2,032,711, it is possible to obtain a positive, diffusion-transfer colour image by means of photosensitive material including a layer which contains a coupler for release of diffusible colouring matter and a spontaneously reducible metal salt, and is provided immediately adjacent to a compound (a DIR compound) able to produce a development inhibitor such as 1-phenyl-5-mercaptotetrazole. In the film unit of the invention, these media and colour image donor materials may be used in combination, and by suitably selection of film unit construction and developing process a positive and/or negative colour image may be obtained.

(c) Reduction agent able to release diffusible colouring matter.

As noted above, as well as colour developer and coupler for production of diffusible colouring matter, the film unit may also employ colour donor material which releases diffusible colouring matter, either as a result of a reaction with an auxiliary medium in a processing solution, or as a result of an inter-molecular reaction in reducing agent which has been oxidized consequent to development. In this type of colour image formation use may be made of the process in which the colour image donor material is oxidized by the agency of an auxiliary developer consisting of a substance such as 3-pyrazolidone or hydroquinone. Colour image donor material thus oxidized releases diffusible colouring matter in response to the action of a complementary agent such as hydrogen acid ions or sulfurous acid ions present in the processing solution or photosensitive material. Specific examples of this type of colour image formation agent are given in U.S. Pat. No. 3,585,026, and No. 3,698,897 D.F.R. Pat. No. 2,242,762.

The colour image donor material of the film unit may be dispersed in various manners, according to the type of donor material in the hydrophilic colloid which acts as a carrier. For example a compound, such as a coupler for production of diffusible colouring matter, which contains dissociable groups such as sulfo or carboxyl groups may be added to the hydrophilic colloid solution after being dissolved in an alkaline aqueous solution. By providing a donor material which is difficult to dissolve in an aqueous medium, but is easily soluble in an organic medium, dissolving the donor material in an organic medium, adding a hydrophilic colloid solution to the solution obtained, then agitating the mixture, and carrying out other suitable procedures, it is possible to effect dispersion of minute particles. Suitable dispersion solvents for such a process that may be cited include ethyl acetate, tetrahydrofuran, methyl ethyl ketone, cyclohexanone, β-butoxy-β-ethoxy ethyl acetate, dimethyl formamide, dimethyl sulfoxide, or 2-methoxy ethanol tri-n-butyl phthalate. Of these dispersion solvents, those which have low vapour pressure volatilize when the photographic layers are dried. Alternatively, volatilization thereof may be caused by treatment according to the methods disclosed in U.S. Pat No. 3,322,027 and No. 2,801,171 prior to coating thereof. Those dispersion solvents which are easily soluble in water may be removed by the water-washing methods disclosed in U.S. Pat. No. 2,949,360, and No. 3,396,027. In order to stabilize dispersion of the donor material and accelerate the process of colour image formation, it is advantageous to incorporate together with the donor material in the photosensitive assembly sheet a solvent which is effectively insoluble in water and has a boiling point not lower than 200° C. High boiling point solvents suited for such a purpose include the higher fatty acids triglycerides, aliphatic esters such as di-octyl adipate, phthalic acid esters such as di-n-butyl phthalate, phosphoric acid esters such as tri-o-cresyl phosphate or tri-n-hexyl phosphate, amides such as N,N-diethyl lauryl amide, or hydroxy compounds such as 2,4-di-n-acyl phenol. Stabilization of dispersion of the colour image donor material and acceleration of the process of colour image formation may also be afforded by incorporation of a lyophylic polymer together with the donor material in the photosensitive sheet, suitable polymers for this purpose being, for example, shellac, phenol-formaldehyde condensate, poly-n-butyl acrylate, copolymer of n-butyl acrylate and acrylic acid, or copolymer of n-butyl acrylate, styrene and methacrylate acid. Such a polymer may be dissolved together with the colour image donor material in an organic solvent and then dispersed in a hydrophilic colloid, or dispersion thereof may be effected by modifying the polymer by emulsion polymerization or similar means, and adding the hydrosol of the polymer thus modified to the disperse phase of the hydrophilic colloidal solution of the colour image donor material. Efficient dispersion of the colour image donor material can generally be achieved by imposition of large shearing forces, suitable equipment for imposition of such forces being, for example, a high-speed rotatory mixer, a colloid mill, a high-pressure milk homogenizer, the high-pressure homogenizer disclosed in U.K. Pat. No. 1,304,206, or a supersonic emulsification equipment. Dispersion is considerably aided by addition to the colour image donor material of a surfactant to serve as an emulsification assistant, surfactants employable for this purpose in the film unit of the invention including tri-isopropyl naphthalene sodium sulfonate, dinonyl naphthalene sodium sulfonate, p-dodecyl benzene sodium sulfonate, dioctyl sulfoxinate, sodium salt, or a salt of cetyl sodium sulfate. There also may be employed the anionic surfactancts disclosed in Japanese Pat. Publication No. 39-4,293, which, as disclosed in U.S. Pat. No. 3,676,141, result in particularly good emulsification when used together with the higher fatty ester anhydrohextol.

The processing solution employed to effect production of a colour image is a liquid composition including necessary components for development of a latent image in the silver halide emulsion and formation of a diffused and transferred colour image, the principal solvent employed being water, although hydrophilic solvents such as methanol or methyl cellosolve also may be employed. The processing solution contains a sufficient amount of alkali to keep hydrogen ion concentration in the silver halide emulsion layer at a level suitable for development of an image therein and also to neutralize acid produced during the various stages of development and colour image formation. The alkali thus included may be in the form of sodium hydroxide, potassium hydroxide, a calcium hydroxide dispersoid, tetramethylammonium hydroxide, sodium carbonate, sodium phosphide, or diethyl amine, for example, and the processing solution should have a pH of approximately 12 or more at room temperature. The solution also preferably includes one or more hydrophilic polymers such as the high molecular weight substances polyvinyl alcohol, or hydroxy ethyl cellulose. Such a polymer or polymers are preferably provided in a proportion such that viscosity of the processing solution at room temperature is at least 1 poise, and, ideally, around 1000 poise, which, as well as facilitating spread of the solution in an even layer during the processing stage, also results in the formation of a non-fluid film when the hydrophilic medium moves to the positive image material and the processing solution becomes concentrated, whereby maintenance of the film unit as an integral unit after processing thereof is assisted. Such a polymer film also assists in preventing change of a produced image since it acts as a barrier to movement of further colouring components to the positive image layer after effective completion of the formation of the diffusion-transfer colour image.

In addition to the abovenoted substances it may sometimes be advantageous for the processing solution to also contain a sensitivity reducer such as disclosed in U.S. Pat. No. 3,579,333, and/or carbon black or similar substance for absorption of light, in order to prevent fogging of the silver halide emulsion by external light during processing. Action of the processing solution may be rendered efficacious by initial incorporation in the colour image donor material of certain processing components. To assist colour developer action such components may be for example development assistants such as para-aminophenol, 4-methyl phenyl hydroquinone, 1-phenyl-3-pyrazolidone, anonium group accelerators such as N-benzyl-a-picolinium bromide, or a fogging prevention agent such as benzatriazole. To assist action of the coupler for release of diffusible colouring matter, these additional components may be, for example, a developer such as a colour developer constituted by a 1st order amine of an aliphatic group, an anti-oxidation agent such as sulfite or ascorbic acid, a fogging prevention agent such as 5-nitrobenzimidazole, or a silver halide solution such as thiosulfate.

The positive image material for production of a viewable colour image serves to fix diffusible colouring matter and other colour image formation substances which define an image pattern and are released from the colour image donor material upon combination thereof with the exposed silver halide emulsion. When the colour image formation substances is an anionic substance, such as a coupler material including an acidic, water-soluble group or groups, or a developing agent containing a hydroquinonyl group or groups, the positive image material should include a basic polumer or a basic surfactant. Basic polymers which are outstandingly good for the purposes of the film unit are polymers which include a structure with a nitrogen atom or atoms in the third or fourth positions, specific examples being poly-4-vinyl pyridine, a polymer of an aminoguanidine derivative of vicyl ethyl ketone such as described in U.S. Pat. No. 2,882,156, poly-4-vinyl-4-benzyl-pyridium, paratoluene sulfonate, poly-3-vinyl-4-methyl-N-n-butyl pyridium bromide, the styrene/N-(3-maleimide propyl)-N,N-dimetheyl-N-(4-phenyl benzyl ammonium salt copolymer): poly N-(2-methacrylloyl ethyl)-N,N-dimethyl-N-dimethyl-N-benzyl ammonium salt described in U.K. Pat. No. 1,261,925. Basic surfactants are most suitably anionic residual groups such as ammonium, sulfinium, or phosphonium radicals, which are brought together by hydrophobic residual groups such as long-chain alkyl groups, specific examples being N-lauryl pyridinium bromide, cetyl trimethyl ammonium bromide, methyl-tri-n-lauryl ammonium paratoluene sulfonate, methyl-ethyl-ammonium fluoride, and benzene triphenyl phosphonium chloride. In addition to these basic salts, compounds of polyvalent metals, for example thorium, aluminium, or zirconium, may serve in fixation of an ionic colour formation substance. It is advantageous if these substances form a film together with a polymer such as gelatine (particularly acid process gelatine), polyvinyl alcohol, polyacryl amide, polyvinyl ethyl ether, hydroxyl ethyl cellulose, N-methoxy methyl polyhexyl methylene adipamide, or polyvinyl pyrrodiline. If the colour image formation substance constitutes a component of a colour formation material such as a diffusion coupler, the positive image layer contains another image-forming coupler component which is able to react with the component constituted by the colour image formation substance. Positive image layers of this type which may be advantageously employed include those described in U.S. Pat. No. 2,647,049, No. 2,661,293, No. 2,698,244, No. 2,698,798, No. 2,802,735, and No. 3,676,124, and U.K. Pat. No. 1,158,440, and No. 1,157,507.

If required, the film unit may include a principal developer scavenging agent which reacts with excess principal developer remaining after processing of the film unit to give a colourless product which is difficult to oxidize. In particular in a film unit in which a neutralization layer contains acid substances of the positive image material, and the abovementioned scavenging agent is included in a neutralization speed modification layer or the positive image layer, it is possible to obtain a clear picture with minimum stains. If the developer of the film unit is an aromatic first order amine, which is liable to produce stains, it is advantageous to employ an isocyanate or aldehyde accelerator and a scavenger constituted as a compound containing functional groups which are able to form a condensate with amines such as vinyl sulfonyl compounds, as disclosed in D.F.R. Pat. No. 2,201,392, No. 2,225,480, and No. 2,225,497.

The photosensitive material of the film unit combines a colour image donor material in a silver halide emulsion, the sensitivity of the emulsion and spectral absorption characteristics of the donor material being selected with respect to the type of colour reproduction contemplated. In order to reproduce natural colours by the colour-subtraction method, the photosensitive material comprises at least two combinations, each of which is a combination of an emulsion which is selectively sensitive to light of certain wavelengths and a compound which denates colour image elements absorptive of light of the same wavelengths. Most suitable combinations are a blue-sensitive silver halide emulsion with a donor compound giving yellow image elements, a green-sensitive emulsion with a magenta-image donor compound, and a red-sensitive emulsion with a cyan image donor compound. These emulsions and donor materials may be combined in the form of separate layers in surface to surface contact or particles thereof may be previously mixed and then applied to the photosensitive material as a single layer.

A preferred multi-layer arrangement for production of a colour photograph is as shown in FIG. 9 referred to above, i.e., an arrangement in which the first assembly sheet 1 comprises in front to rear order a first transparent support 11, yellow dye donor layer 121, blue-sensitive silver halide layer 122, yellow filter layer 123, magenta dye donor layer 124, green-sensitive silver halide layer 125, intermediate layer 126, cyan dye donor layer 127 red-sensitive silver halide layer 128, and protective layer 129, the layers 121 through 129 being supported by the first transparent support 11. The yellow filter layer 12 may be for example a silver dispersoid in a yellow colloid, a dispersoid of an oil soluble yellow colouring material, acidic colouring matter mordanted by a basic polymer, or basic colouring matter mordanted by an acidic polymer. To prevent undesirable interaction between the different layers of emulsion, it is advantageous to separate the layers by one or more intermediate layers, such as layer 126 in FIG. 9, which may be constituted by a hydrophilic polymer such as gelatine, polyacryl amide, or a partial hydrolysate of polyvinyl acetate, a polymer having fine holes therein and formed from the latex of a hydrophobic polymer and a hydrophilic polymer such as described in U.S. Pat. No. 3,625,685, or a polymer whose affinity for water is gradually increased under the influence of calucium alginate or similar processing solution, as described in U.S. Pat. No. 3,384,483. Depending on the type of processing solution and colour image donor material employed, an intermediate layer may also include an inhibitor of inter-layer reaction. For example, if the colour image donor material is of a type which is caused to release diffusible colouring matter by oxidation products of the developing solution, undesired reactions of developer oxidation products between different sets of emulsion layers may be effectively prevented by an anti-diffusion coupler, such as a hydroquinone derivate, which may react with and fix a reduction agent and oxidation product. Good colour reproduction is also assisted by including in the intermediate layer physical development nuclei in the form of a metallic silver colloid for example, if the process is an image-reversal process using a dissolving developer, or fine grains of silver halide with low sensitivity, if image-reversal is effected using a development inhibitor release (DIR) compound.

For production of a black and white the positive image layer of the film unit includes silver precipitation nuclei. These nuclei, which are sometimes also referred to as physical development nuclei, serve to accelerate reduction of silver salts, and may be constituted in substances such as sulfides, selenides or tellurides, which are difficult to dissolve in water and are formed from metals such as zinc, mercury, lead, cadmium, iron, chrome, nickel, tin, cobalt, copper, silver, or gold, heavy metals such as silver, gold, platinum, or palladium, or anti-diffusion polymer compounds which are rendered immobile upon combination with a silver salt such as polyvinyl mercapto-acetate. As well as those substances there may also be employed other known compounds providing physical development nuclei, such as disclosed in U.S. Pat. No. 2,352,014, No. 2,740,717, and No. 3,620,155, for example. These substances are generally more effective if present in the form of fine grains in a colloidal solution, a suitable average diameter of the nuclei being in the range of 10–2500 angstroms. Production of such fine colloidal grains of inorganic substances which are difficult to dissolve may be effected by various known techniques. For example, there may be provided a protective colloid, e.g., of gelatine, polyvinyl, alcohol, carboxy methylcellulose gum arabic colloidal silicate, in the presence of which the corresponding metal salt is reduced, thereby to produce a metal colloid, or a soluble sulphide is caused to act on a solution of the corresponding metal salt thereby to produce a sulphide dispersoid. Further details of methods of preparation of nucleic dispersoids are given in Gmelins Handbuch der anorganischen Chemic (Verlag chemie, Weinheim), reference to relevant sections of which will afford an easy selection of suitable methods and substances. According to one method which may be included in the cited preparation methods, the abovenoted substances are dispersed in a hydrophilic polymer such as gelatine, polyvinyl alcohol, polyacrylamide, or hydroxy ethyl cellulose. Another method is a method such as described in U.S. Pat. No. 3,234,022, and No. 3,295,972, according to which a metal is vacuum-sputtered on a high polymer material. A further method which may be suitably employed is that disclosed in U.S. Pat. No. 3,607,269, according to which the required colloid is incorporated in a regenerated cellulose produced from hydrolysed cellulose acetate. Improvement of the hue of a produced image, formed by the silver precipitation nuclei may be achieved by employing together with the positive image layer an aryl mercapto compound or hetero ring mercapto compound. Specific examples of toner which may be usefully employed for this purpose are given in the articles by G. F. Van Veelan et al. in Volume 99, pages 39–145 of Photographische Korrespondenz, and in U.K. Pat. No. 969,996, U.S. Pat. No. 3,433,640, and D.F.R. Pat. No. 1,942,884.

The developer provided in the film unit for production of a black and white image is a strong developer able to dissolve silver halides and silver salts (complex silver salts), preferably includes an accelerator for imparting hydrolytic characteristics thereto, and may be located in various portions of the film unit, for example in the processing solution, in the photosensitive emulsion layer, or in the positive image layer. Preferred developers include alkyl hydroquinones such as hydroquinone or t-butyl hydroquinone, aryl hydroquinones such as phenyl hydroquinone, alkoxy hydroquinones such as ethoxy hydroquinone, hydroquinone derivatives such as described in U.S. Pat. No. 2,939,788, No. 3,002,997, No. 3,003,876, No. 3,019,108, and No. 3,065,075, N-methyl-p-aminophenyl, N,N-dimethyl-p-aminophenol, the N-substitution aminophenol described in U.S. Pat. No. 3,091,530, catechol or related substances, or benzoid series developers such as p-phenylene diamine. As well as these substances there may be usefully, employed reduction agents having an open chain structure, for example, hydroxyl amine, N-dimethoxy ethyl hydroxyl amine, N,N-diethyl hydroxyl amine, the hydroxyl amines described in U.S. Pat. No. 3,293,034, ascorbic acid, of Redukton and Amino-Redukton. A further substance which may be employed is 1-phenyl-3-pyrazolidonone or a substitution derivative thereof.

For the purpose of production of a black and white image, there is provided in the film unit an agent for formation of silver salts which is able to cause silver halides dissolved in an alkali solution to form stable complex salts of silver, this agent being most suitably provided in the processing solution. Among suitable agents for such formation of complex salts of silver there may be cited inorganic compounds such as sodium, potassium or ammonium thiosulfate or thiocyanate, a cyclic imide compound such as described in U.S. Pat. Nos. 2,857,274, No. 2,857,275, and No. 2,857,276, e.g., uracil, barbizolic acid, hydantoin, etc., ethyl amine, ethanol amine and other amines described in U.S. Pat. No. 3,343,958, amine and cysteine combinations such as described in U.S. Pat. No. 3,343,958, or bis-sulfonyl methane and other active methylene compounds such as described in Japanese Patent Publication No. 48–43,934, for example.

When the film unit of the invention is required to produce a black and white photograph, the processing solution is a liquid medium, in which the principal solvent is water, but which may also include methanol, methy cellosolve or similar hydrophilic solvents, and which contains a necessary processing component or components for developing an image in the silver halide emulsion and dissolving silver halides. The processing solution also contains a sufficient amount of an alkaline substance or substances to maintain the level of hydrogen ion concentration necessary to allow image development to proceed in the photosensitive emulsion layer, and to neutralize acid produced during this development. This alkaline substance is preferably a substance having a pH of 12 or more at room temperature, suitable substances being sodium hydroxide, potassium hydroxide or calcium hydroxide in the form of a disperse phase, tetramethylammonium hydroxide, sodium carbonate, sodium sulfite, and diethyl amine, for example. The processing solution also preferably contains a hydrophilic polymer or polymers of high molecular weight, for example polyvinyl alcohol hydroxy ethyl cellulose, or sodium carboxy methyl cellulose. Such a polymer or polymers are provided in suitable proportions to impart to the processing solution a viscosity of more than 1 poise, and preferably of 1000 poise, at room temperature, in order to achieve the advantages noted above in reference to processing solution for a colour photograph, i.e., good spread of the solution and subsequent formation of an immobile film which assists bonding of dissolved silver of the positive image layer after completion of image formation.

Since the processing solution of the film unit has a comparatively high pH of 10, or preferably 11, or more, which is necessary for maintenance of alkaline conditions requisite to the various stages of image development in the silver halide emulsion layer, formation and diffusion of diffusible image elements, etc., it is advantageous to provide a neutralization material which, when diffusion and transfer of the photographic image onto the positive image layer has been effectively completed may bring pH of the film unit down to a value adjacent to the neutral value, for example less than 9, or preferably less than 8, and so prevent further image formation processes, whereby subsequent discoloration of the completed photograph or brown discoloration of white portions thereof due to the action of strong alkaline substances initially present in the film unit is avoided, and good tone and hue of the completed image are maintained for a long time. Such neutralization may be effectively accomplished by the incorporation in the film unit of a layer, such as layer 22 of FIG. 2, of an acidic substance having an area density at least equal to that occupied by the alkaline substance of the processing solution when the solution is spread through the film unit. Suitable acidic substances which may be cited include acidic groups with a pKa of 9 or less, carboxyl groups or sulfonic acid groups being particularly suitable, or substances including accelerator groups able to give such acidic groups as a result of hydrolysis. Preferred substances include oleinic acid and similar higher fatty acids such as described in U.S. Pat. No. 2,983,606, polymers of acrylic acid, methacrylic acid or maleic acid, such as described in U.S. Pat. No. 3,362,819, and partial esters or acid anhydrides of these substances. Specific examples of high molecular substances which may be employed for this purpose include copolymers of anhydrous maleic acid and ethylene or a vinyl monomer substance such as vinyl acetate, vinyl methyl ether, etc., copolymers of acrylic acid and n-butyl hemi-ester and/or butyl acrylate, or cellulose acetate-acidic phthalate. In addition to these acidic substances the neutralization layer may also include polymers such as cellulose nitrate or polyvinyl acetate, or may include a plasticizer such as described in U.S. Pat. No. 3,557,237. The neutralization layer may also be hardened by the bridging reaction of multi-functional substances such as aziridine or epoxy compounds included therein. A neutralization layer may be provided in the positive image material and/or in the photosensitive material. A particularly suitable location is between the positive image layer and the support of the positive image layer. If required, the acidic substance may be provided in microcapsules incorporated in the film unit, in the manner described in D.F.R. Pat. No. 2,038,254.

It is preferable that a neutralization layer and layer containing acidic substance as employed in the film unit of the invention be separated from a layer of processing solution spread through the film unit by a layer, such as layer 23 in FIG. 10, containing a substance for control of speed of neutralization, in this case to retard neutralization. Such a neutralization retarder layer serves to prevent the neutralization layer from acting too quickly and lowering the pH of the processing solution before required development of the silver halide emulsion layer and formation of a diffusion-transfer image have been effected, and delays lowering of the pH of the processing solution until development and image transfer have been satisfactorily completed, whereby problems such as undesirable lowering of density in a finished print are avoided. In a preferred embodiment of the invention, the positive image portion of a film unit has a multi-layer structure in which there are provided, in order, a support layer, a neutralization layer, a neutralization retarder layer, and a mordant layer (positive image layer). The neutralization retarder layer may have as principal component a polymer such as gelatine, polyvinyl alcohol, polyvinyl propyl ether, polyacryl amide, hydroxy propyl methyl cellulose, isopropyl cellulose, partial polyvinyl butyl, partially hydrolysed polyvinyl acetate, or a copolymer of β-hydroxy ethyl methacrylate and ethyl acrylate, for example. If such polymers are employed it is advantageous to effect hardening thereof by means of a bridging, reaction using, for example, an N-methylol compound or aldehyde compound such as formaldehyde. The thickness of the neutralization retarder layer is preferably from 2 to 20 microns.

The film unit of the invention employs a light-reflecting substance provided in the layer 25 of FIG. 10, for example, in order to provide a white background to a colour image formed in the positive image layer, substances employed being for example titanium dioxide, barium sulfide, zinc oxide, barium alumina-stearate, calcium carbonate, silicate, zirconium oxide, or kaolin magnesium oxide, these substances being used singly or mixed. Such light-reflecting substance may be previously formed in a film unit, i.e., disposed to constitute a white background during initial production of the film unit, or may be distributed within the film unit and caused to form a white background in specific portions of the film unit under the influence of a drive or precursor agent, in the manner disclosed in Belgium Pat. No. 768,110, and No. 768,111. The light-reflecting substance may be incorporated in a layer employing as bonding agent a hydrophilic polymer such as polyvinyl pyrrolidine, or may be in the form of a disperse phase in a layer of hydroxy ethyl cellulose, carboxy methyl cellulose or other polymer with film-forming ability, which is provided in the processing solution and is formed upon spread of the processing solution through the film unit. A more attractive white background may be obtained by employing in combination with the light reflecting substance a fluorescent whiteness improvement agent such as stilbene, coumarin, or tri-azine. It is also advantageous to employ in association with the light reflecting layer colouring matter such as that disclosed in Belgium Pat. No. 743,336, No. 768,107, and No. 768,109, which is coloured when the pH thereof is higher than the pKa thereof, but is rendered colourless when the pH thereof is lower than the pKa thereof. The ratio by weight of light reflecting substance to bonding agent polymer in the layer containing the light reflecting substance is suitably from approximately 0.5 to approximately 100, and this layer preferably has a thickness of 5 microns to 100 microns. The reflectance of the layer should be over 50%, and preferably over 70%.

As noted above the camera employed in the method of the invention may have an ordinary exposure system not requiring inclusion of image-reversing means, and comprises a reception compartment for accommodation of one or more exposed film units and provision of lightproof protection to such film units until completion of photographic processes therein, this reception compartment being detachably mounted, by spring or hinge elements for example, or fixedly attached to a side portion of the camera, being foldable, if required, to provide a more compact assembly during non-use of the camera, and comprising an opening, via which an image, in the positive image layer may be viewed, and over which there may be provided, if required, a sheet of glass, acryl resin, vinyl chloride, or other suitable transparent substance ensuring exclusion of dust. Alternatively the reception chamber may be provided on the rear of the camera adjacent to and generally in flat alignment with respect to a pack containing film units, or may be constituted as a rear portion of such a film pack. In the latter case, the rear wall of the camera defines a transparent rear wall portion corresponding to the viewal opening of the reception compartment. The film pack may of course be provided with suitable film unit forwarding control means and power supply means, in the form of conventionally known rod, block, or plate batteries, for example, to permit use of the film pack in a camera including means for automatic control of exposure. The film units may be constituted as independent, unattached units, or may be attached by leaders. If required the film units may be of the type disclosed in Japanese Patent Publication No. 47-17,425, U.S. Pat. No. 3,767,404, or Japanese Patent Publication No. 47-17,423, U.S. Pat. No. 3,770,441, according to which processing solution containers may be detached from film units subsequent to completion of development processes.

Needless to say, various types of means for reception of exposed film units may be employed without departure from the principles of the invention. For example, according to another embodiment shown in FIGS. 12 through 20, to which reference is now had, there is provided an envelope 200 in association with each film unit.

Figure 13:
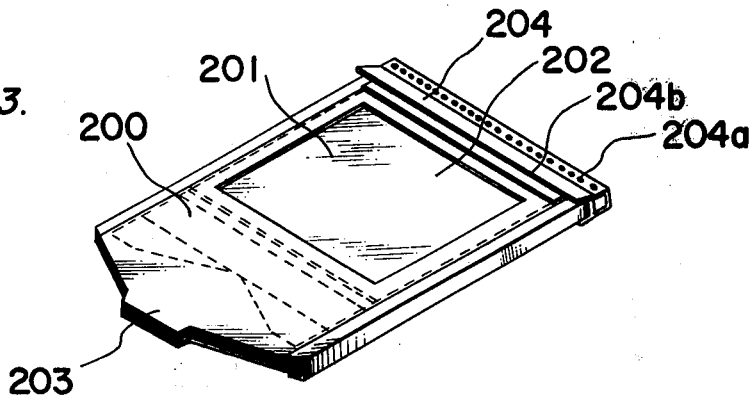
FIG. 13 is a rear perspective view of the envelope of FIG. 12.
Figure 14:
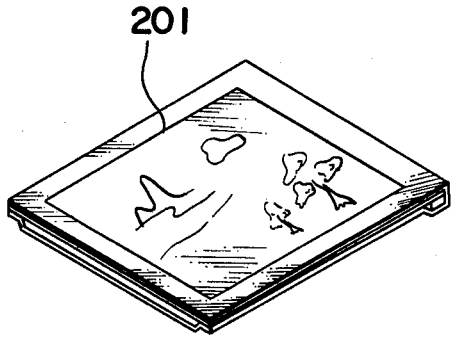
FIG. 14 is a perspective view of a positive print obtained after removal of a film unit from the envelope of FIG. 12.

In FIGS. 12 and 13, the envelope 200 is made of an opaque and comparatively rigid material, defines a generally rectangular main portion of which the sides and one end are sealed, has formed at the sealed end thereof a projecting flap portion 203 to facilitate holding of the envelope 200 by a photographer, and has a rear wall portion defining a an opening 202 via which an image formed in the positive image layer of the film unit 201 may be viewed. When the film unit 201 is contained in the envelope 200 the leading end of the film unit 201, i.e. the end thereof carrying a processing solution container is nearest to the sealed end of the envelope 200. Attached to the other end of the film 201 there is a grip portion 204 comprising a bracket-shaped base portion **204*a* and slightly flexible grip projections 204*b* which are fixedly attached to the base portion 204*a* and may grip the edge portions of the open end of the envelope 200, whereby the film unit 201 may be retained in the envelope 201, and light prevented from entering the envelope 200 via the open end thereof. In this situation, the film unit 201 fits exactly into the envelope 200, whereby the rear of the film unit is viewable via the opening 202 but the photosensitive, latent image layer of the film unit 201 is protected from light by the opaque layer of the film unit 201 and by the solid portions of the envelope 200. The grip portion 204 may be disengaged from the envelope 200 to permit withdrawal of the film unit 201 from the envelope 200 as illustrated in FIG. 15, and may be detached from the film unit 200 whereby, after exposure and processing of the film unit 200 a completed print having no unrequired portions attached thereto may be obtained, as illustrated in FIG. 14**.

Figure 16:
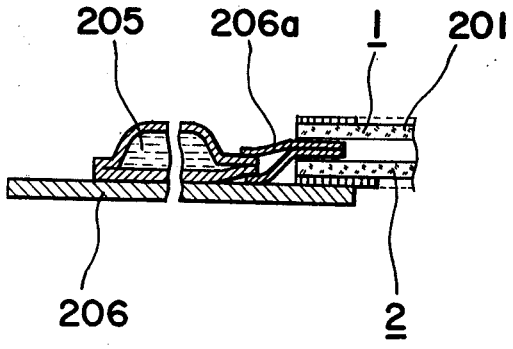
FIG. 16 is a partial cross-sectional view showing processing solution container attachment means of a film unit employable in association with the envelope of FIG. 12.

Referring to FIG. 16, the processing solution container 205 of the film unit 200 is suitably mounted on a leading edge extension 206 of the film unit 200 and is conducted by guide walls **206*a* to the first assembly sheet 1 and second assembly sheet 2 of the film unit 201, processing solution being directed by the guide walls 206*a* into the space between the first and second sheets 1 and 2 upon passage of the film unit 201** through suitable pressure means.

Figure 17:
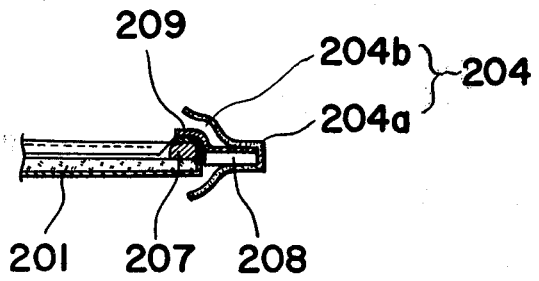
FIG. 17 is a cross-sectional view illustrating connection with a fixture portion of the film unit of FIG. 16.

Referring to FIG. 17, which shows the grip means 204 in greater detail, the bracket portion **204*a* is fixedly attached to a reinforcement block 208 having fixedly attached thereto one edge portion of a connecting strip 209 whose opposite edge portion is detachably bonded to the trailing edge of the film unit 201, the grip means thus being detachable from the film unit 201, as noted above. Along the trailing edge of the film unit 201 there is provided a trap means 207** for entrapment of excess processing solution not employed in production of a photograph.

Figure 15:
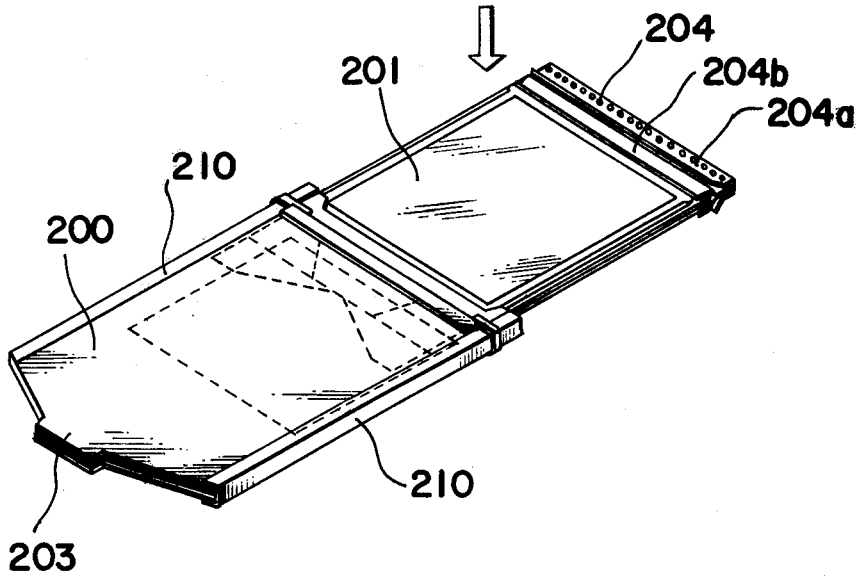
FIG. 15 is a perspective view illustrating the mode of withdrawal of a film unit from the envelope of FIG. 12.
Figure 18:
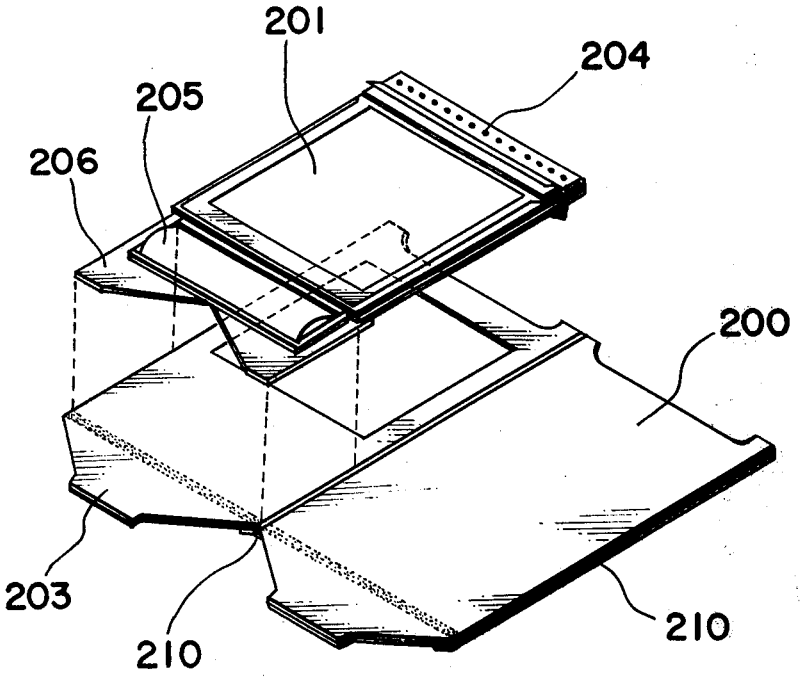
FIG. 18 is a disassembly view of the envelope of FIG. 12.

As illustrated in FIG. 15 and 18, the envelope 200 is suitably constituted by two sheets of generally equal dimensions which are bonded by adhesive agent for example along the leading edge portions thereof, i.e., adjacent to the flap portion 203, and whose side edge portions are held together and reinforced by retainer strips 210.

Referring now to FIG. 19, employment of the abovedescribed envelope 200 and film unit 201 is as follows. Prior to use of the film unit 201, the film unit 201 may be stored outside a camera while contained in the envelope 200, in which condition the grip portion 204 of the film unit 201 closes the open end of the envelope 200, where by the latent image layer of the film unit 201 is protected from light. In FIG. 19 (*a*), holding the flap portion 203, the photographer inserts the envelope 200 and film unit 201 as a complete assembly into a camera, indicated by the dotted line portion of the drawing this assembly being passed through processing roll means which are provided in the camera, and are caused to be moved apart at this time, in order to permit unhindered entry of the envelope and film unit assembly. In FIG. 19 (*b*), when the assembly has been completely inserted into the camera, the film unit 201 is in a correct position for exposure thereof, and the grip means 204 is engaged by a retainer means 211, which is provided in the camera and is constituted, for example, by a pivotal hook means which is normally urged to a position to engage the outer edge portion of one side of the grip means 204. At this stage the flap portion 203 of the envelope 200 still extends to the exterior of the camera. In FIG. 9 (*c*), next the photographer moves the envelope 200 from the camera, by pulling the flap portion 203. When this is done the film unit 201 remains in the camera due to the engagement of the grip portion 204 by the retainer means 211. Thus the forward side of the latent image layer of the film unit 201 is no longer protected by the envelope 200, whereby, upon subsequent actuation of a shutter means (not shown) the latent image layer is exposed to light directed thereonto by the lens system of the camera. In FIG. 9 (*d*), next the envelope 200 is re-inserted into the camera, to enclose the exposed film unit 201, and camera means not shown are actuated to cause the retainer means 211 to disengage the grip portion 204, which therefore again grips the end portion of the envelope 200, and move the processing roll means in suitable proximity to one another to permit the roll means to break open the processing solution container 205 of the film unit and cause spread of processing solution through the film unit upon passage of the film unit through the roll means. In FIG. 9 (*e*), the envelope 200 and the exposed film unit 201 retained therein due to the action of the grip portion 204 are pulled out of the camera, passing through the processing roll means, which causes spread f processing solution through the film unit which causes development of the latent image layer of the film unit and diffusion and transfer of a corresponding image to the positive image layer thereof.

The film unit 201 may be left in the envelope 200, in which case the positive image formed therein is viewable through the opening 202 of the envelope 200, as illustrated in FIG. 20, or after sufficient time for completion of photographic processes in the film unit 201, the film unit 201 may be removed from the envelope 200 and the grip portion 204 detached to provide a rectangular print as illustrated in FIG. 14. When the envelope 200 is employed as reception means, since no other protection, by a film pack or similar means, is provided for the latent image layer of the film unit 201, the opaque layer of the film unit 201 must of course be of a type which is initially opaque, and not one which is formed subsequent to spread of processing solution through the film unit.

The opaque layer may, however, be of any type if, as illustrated in FIG. 21, film units are initially provided in a pack which is loadable into a camera and provides lightproof protection to both sides of film units prior to loading thereof into the camera, and there are provided in a side compartment 212 of the camera a number of envelopes 200 equal to the number of film units 201. In this case, successively exposed film units 201 are moved out of the pack and into corresponding envelopes 200, which are successively moved to a position for reception of an exposed film unit by spring plate means 213 and are subsequently removable from the compartment 21.

It is also possible to employ a flexible envelope 214, which is made of lightproof material, defines an open portion permitting viewing of a positive image formed in a film unit 201, is initially in a rolled condition, as shown in FIG. 22 (I), and is extendable as shown in FIG. 22 (II) upon insertion of a film unit 201 thereinto. When such reception means are employed, as illustrated in FIG. 23 (I), film units 201 are initially provided in a pack, and an envelope 214 is provided in line with an exit opening formed in a camera wall and with processing roll means through which a film unit 201 is passed subsequent to exposure thereof, successive envelopes 214 being moved to this position along guide rails, (not shown), for example. An exposed film unit 201 which is passed through the processing roll means is inserted into the envelope 214 which is extended, as shown in FIG. 23 (II), thus provides requisite lightproof protection to the film unit 201 as the film unit 201 is moved from the camera via the exit opening thereof.

As clear from the above description principal advantages of the photographic method and film unit of the invention may be summarized as follows.

1. The inventon permits use of an ordinary camera not requiring additional mirrors or other optical means for image-reversal.
2. According to the invention an exposed film unit may be removed from a camera immediately subsequent to exposure thereof and, while photosensitive portions of the exposed film unit are protected from light, formation of an image in a positive image portion thereof may be viewed, whereby a photographer may have the pleasure of observing the process of formation of a photographic image, and may also know rapidly whether or not an object has been photographed in a required manner, and so may take another photograph of the object if necessary.
3. The film unit of the invention permits production of a positive print which is viewable without it being necessary to detach protective or other sheet portions from the film unit.

4. Because the reception means for exposed film units provided according to the invention provides protection to the forward side of the photosensitive portion of an exposed film unit, the film unit need only include lightproof protection for the rear side of the photosensitive portion thereof, and hence may have a simpler construction.

What is claimed is:

1. A photographic method for exposing and developing a diffusion-transfer type film unit comprising a first transparent sheet and a second tranparent sheet which are bonded along edge portions thereof, and between which there are provided, in order from the side of said first transparent sheet nearest to said second transparent sheet, at least one photo-sensitive silver halide emulsion layer which is able to define image elements constituting an image as the result of development and is able to release image-formation material in correspondence to said image elements under the influence of processing solution brought into contact therewith and a transfer image layer able to have transferred thereonto and to fix image elements released by said photosensitve layer, and, between said photosensitive layer and said transfer image layer, a lightproof protection means able to provide lightproof protection to one side of said photosensitive layer at least subsequent to spread of processing solution through said film unit, said unit also containing a processing solution container provided at the leading edge of said first transparent sheet and being breakable by pressure means through which said film unit is past, and being so disposed and constructed that said processing solution may be extruded therefrom and spread between said first transparent sheet and said second transparent sheet upon passage of said film unit through said pressure means, wherein said film unit is placed in a camera for exposure, said method including the steps of:

exposing said photosensitive layer to image-wise light directed through said first transparent sheet, moving said exposed film unit through a pair of pressure means and spreading processing solution through said film unit during said movement, during and subsequent to said movement of said film unit through said pressure means providing lightproof protection by placing said film unit into a reception compartment made of an opaque material and defining an opening through which an image formed in said transfer image layer of said film unit may be viewed to prevent impingement of light on said first transparent sheet whereby complete lightproof protection is provided to said photosensitive layer, maintaining said lightproof protection for a time sufficient for effective completion of photographic processes in said film unit, and simultaneously bringing said second transparent sheet to and maintaining the same in a position permitting viewing therethrough of an image formed in said film unit.

2. The process of claim 1, the photographic film unit comprising:

a dimensionally stable first transparent support sheet, a photosensitive sheet supported on said first transparent support sheet and including at least one photosensitive silver halide emulsion layer and image-formation material in association therewith, which layer is able as the result of development to define image elements constituting an image, and is able to release image-formation material in correspondence to said image elements under the influence of a processing solution brought into contact therewith, a dimensionally stable, transparent second support sheet having effectively the same major dimensions as said photosensitive sheet, a transfer image sheet support on said second transparent support sheet, including a transfer image layer to form a fixable image corresponding to an image formed in said photosensitive sheet, sheet fixture means provided along edge portions of said film unit and maintaining said photosensitive sheet and said transfer image sheet and said photosensitive layer and said transfer image layer included therein in a surface-to-surface relation.

a processing solution container provided at the leading edge of said photosensitive sheet, being breakable by pressure means through which said film unit is passed, and being so disposed and constructed that said processing solution may be extruded therefrom and spread between said photosensitive sheet and said transfer image sheet upon passage of said film unit through said pressure means, and a lightproof protection layer permeable to processing solution, provided between said photosensitive sheet and said transfer image sheet to provide lightproof protection to one side of said photosensitive sheet at least subsequent to spread of said processing solution through said film unit, whereby subsequent to exposure of said photosensitive layer to image-wise light directed through said first transparent support sheet there may be formed in said transfer image layer a positive image which corresponds to an image formed in said photosensitive layer and is viewable through said second transparent support sheet.

3. The process of claim 1, wherein said lightproof protection layer is supported by said first transparent support sheet.

4. The process of claim 1, wherein said lightproof protection layer is supported by said second transparent support sheet.

5. The process of claim 1, wherein said lightproof protection layer is constituted by a substance which is absorptive of light when in an uncombined state.

6. The process of claim 1, wherein said lightproof protection layer is constituted by a substance which becomes absorptive of light upon combination thereof with at least one substance contained in said processing solution.

7. The process of claim 1, the photographic film unit being a diffusion-transfer type photographic film unit comprising:

a first transparent sheet and second transparent sheet bonded to one another along edge portions thereof, a least one photosensitive silver halide emulsion layer for, as the result of development, defining image elements constituting an image and for releasing image-formation material under the influence of processing solution brought into contact therewith, at least one transfer image layer for transferring thereonto said image-formation material released by said photosensitive layer to form a fixable image corresponding to an image formed in said photosensitive layer and said transfer image layer being provided between said first and second transparent sheets and said transfer image layer being nearer to said second transparent sheet, a processing solution container, which contains an alkaline processing solution, and is breakable by pressure means through which said film unit may be passed, and being so constructed and disposed that said processing solution may be extruded therefrom and spread between said first and second transparent sheets upon passage of said film unit through said pressure means, and said lightproof protection means to prevent passage of light between said photosensitive layer and said transfer image layer at least subsequent to spread of said processing solution through said film unit and being an opaque layer present in the unit prior to exposure or formed when said processing solution spreads through said unit.

8. A photographic method as recited in claim 1, wherein subsequent to spread of processing solution through said film unit said film unit is moved outside a camera.

9. A process as claimed in claim 7, wherein the photographic film unit further includes a neutralization layer either associated with said photosensitive layer and/or with said transfer image layer containing an acidic substance in sufficient quantity to effectively neutralize alkaline processing solution spread through said film unit.

10. The process as claimed in claim 9, wherein said neutralization layer contains an acidic substance in an amount at least equal to the amount of alkaline substance contained in said processing solution spread through said film unit.

11. The process as claiamed in claim 9, wherein said neutralization layer contains a polymer containing at least one group selected from carboxyl groups and sulfone groups.

12. The process as claimed in claim 7, wherein said processing solution contains a viscosity increasing agent.

13. The process as claimed in claim 7, wherein said processing solution contains a silver halide development agent.

14. The process as claimed in claim 7, wherein said image-formation material is a diffusable dye image forming material.

15. The process as claimed in claim 14, wherein said neutralization layer includes an acidic substance in sufficient quantity to bring the pH of said alkaline processing solution to a level at which dye image forming processes are effectively stopped subsequent to effective completion of colour image formation in said film unit.

16. A process as claimed in claim 14, wherein said diffusable dye image forming material is dye developer containing a silver halide development group.

17. The process as claimed in claim 16, wherein said development group is selected from the ortho- and para-dihydroxy phenyl groups.

18. A process as claimed in claim 14, wherein said diffusable dye image forming material is a color coupler capable of releasing diffusable dyes after coupling with oxidized color developing agent.

19. The process as claimed in claim 18, wherein said development agent is an aromatic first order amine development agent.

20. The process of claim 14 wherein the photographic film unit further includes at least one emulsion layer wherein the colour image element absorption wavelength range of said diffusable dye image forming material and the light absorption wavelength range of said silver halide emulsion combined therewith are effectively made coincident.

21. The process as claimed in claim 20, wherein said diffusable dye image forming material effects absorption in correspondence to blue-sensitive, green sensitive, and red-sensitive emulsions.

22. The process as claimed in claim 7, wherein said processing solution includes a silver halide solvent.

23. The process as claimed in claim 7, wherein said photosensitive sheet and said said transparent sheet constitute an integral unit while in parallel relationship to one another during exposure and development processes effected in said film unit.

24. The process as claimed in claim 23, wherein said processing solution container is fixed along one edge of said laminate integral unit constituted by said photosensitive sheet and said transparent sheet.

25. The process of claim 7 wherein the photographic film unit further includes a light reflection layer provided at least subsequent to spread of said processing solution between said transfer image layer and said photosensitive layer.

26. The process as claimed in claim 25, wherein said light reflection layer is a polymer layer permeable to processing solution and containing titanium dioxide.

27. The process as claimed in claim 25, wherein said light reflection layer is provided by a processing solution containing light reflection substance.

28. The process as claimed in claim 7, wherein said light protection layer is a polymer layer permeable to processing solution and containing a substance absorptive of light.

29. The process as claimed in claim 28, wherein said polymer layer is provided on said photosensitive layer.

30. A photographic film unit as claimed in claim 28, wherein said polymer layer is provided on said transfer image layer.

31. The process as claimed in claim 7, wherein said lightproof protection means is provided by a polymer layer permeable to processing solution and containing a light reflection substance and a polymer layer permeable to processing solution and containg a light absorption substance.

32. The process as claimed in claim 31, wherein said light absorption substance is carbon black.

33. The process as claimed in claim 7, wherein said processing solution contains a light reflection substance which in combination with said light protection means protects said photosensitive layer from light upon spread of said processing solution through said film unit.

34. The process as claimed in claim 33, wherein said light protection means is a pH dye indicator.

35. The process of claim 1, the photographic film unit comprising:

a dimensionally stable transparent support having provided in order thereon a transfer image layer to have transferred thereonto and to fix image-formation material, an opaque layer permeable to processing solution and preventing passage of light, at least one photosensitive silver halide emulsion to define image elements constitutiong an image as the result of development and to release diffusable image formation material in a processing solution, said layers together constituting a photosensitive sheet, and said first transparent sheet being a dimensionally stable transparent sheet having effectively the same major dimensions as said photosensitive sheet and retaining processing solution spread through said film unit, said transparent sheet permitting direction of image-wise light therethrough to expose said photosensitive sheet and said transparent support permitting viewing of an image formed in said transfer image layer, sheet fixture means in fixed attachment to edge portions of said photosensitive sheet and said transparent sheet and maintaining said sheets in a surface-to-surface relationship, a processing solution container which contains an alkaline processing solution, provided along the leading edge of said photosensitive sheet, and being breakable by pressure means for spreading processing solution between said photosensitive sheet and said transparent sheet.

36. A photographic method as claimed in claim 1, wherein said step of providing lightproof protection to the first transparent sheet side of said film unit subsequent to passage of said film unit through said pressure means comprises moving said unit into said reception compartment mounted on said camera.

37. A photographic method as claimed in claim 1, wherein said reception compartment is an independent reception compartment and said step of providing lightproof protection to the first transparent sheet side of said film unit subsequent to passage of said film unit through said pressure means comprises moving said unit into said reception compartment prior to passage of said film unit through said pressure means.

38. A photographic method as claimed in claim 1, wherein subsequent to spread of processing solution through said film unit said film unit remains located in the interior of a portion of a camera.

39. A photographic method as claimed in claim 1, wherein subsequent to spread of processing solution through said film unit said film unit is moved to a reception space in facing contact with the a portion of a camera.

40. A photographic method as claimed in claim 39, wherein said reception compartment is an envelope made of an opaque material and forming an opening through which an image formed in said film unit may be viewed.

41. A photographic method as claimed in claim 40, wherein said film unit is initially contained in said envelope, said envelope containing said film unit is first inserted into a camera, said envelope only is then withdrawn from said camera, said film unit is exposed to image-wise light, said envelope is re-inserted into said camera to again enclose said film unit, and said envelope and said exposed film unit are then together withdrawn to the exterior of said camera via pressure means which cause spread of processing solution through said film unit.

42. A photographic method as claimed in claim 40, wherein said film unit is moved into said envelope while being processed and moved to the exterior of said camera.

* * * * *